US010307625B2

(12) United States Patent
Cray

(10) Patent No.: US 10,307,625 B2
(45) Date of Patent: Jun. 4, 2019

(54) FLAME MITIGATION DEVICE FOR PORTABLE FUEL CONTAINERS

(71) Applicant: NSIP Holdings, LLC, Lenexa, KS (US)

(72) Inventor: Thomas M. Cray, Mission Hills, KS (US)

(73) Assignee: NSIP Holdings, LLC, Lenexa, KS (US)

( * ) Notice: Subject to any disclaimer, the term of this patent is extended or adjusted under 35 U.S.C. 154(b) by 0 days.

(21) Appl. No.: 15/892,119

(22) Filed: Feb. 8, 2018

(65) Prior Publication Data

US 2018/0221693 A1 Aug. 9, 2018

Related U.S. Application Data

(60) Provisional application No. 62/456,456, filed on Feb. 8, 2017.

(51) Int. Cl.

| | |
|---|---|
| ***B65D 25/38*** | (2006.01) |
| ***A62C 3/06*** | (2006.01) |
| ***A62C 4/00*** | (2006.01) |

(52) U.S. Cl.

CPC ..... *A62C 3/065* (2013.01); *A62C 4/00* (2013.01)

(58) Field of Classification Search

CPC ..... B65D 25/385; B60K 2015/03381; Y10T 403/60; Y10T 403/606

USPC ..... 220/88.1, 88.2, 845; 285/317, 319, 921

See application file for complete search history.

(56) References Cited

U.S. PATENT DOCUMENTS

| | | | |
|---|---|---|---|
| 2,275,318 | A | 3/1942 | Rasmussen |
| 2,335,195 | A | 11/1943 | Packer |
| 3,770,160 | A | 11/1973 | Flider |
| 3,927,797 | A | 12/1975 | Flider |
| 4,273,265 | A | 6/1981 | Anderson |
| 4,489,860 | A | 12/1984 | Flider |
| 4,927,045 | A | 5/1990 | Lichka |
| 2,365,695 | A | 12/1994 | Grice |
| 5,505,849 | A | 4/1996 | Rama, Jr. |
| 6,003,735 | A | 12/1999 | Strecker |
| 6,390,153 | B1 | 5/2002 | Flider et al. |
| 6,772,918 | B2 | 8/2004 | Mack, Jr. |

(Continued)

FOREIGN PATENT DOCUMENTS

| | | |
|---|---|---|
| GB | 19322641 | 10/2013 |
| WO | 2013117921 A1 | 8/2013 |

*Primary Examiner* — Marina A Tietjen
*Assistant Examiner* — Paul J Gray
(74) *Attorney, Agent, or Firm* — Hovey Williams LLP

(57) ABSTRACT

A flame mitigation device configured to be located proximate a main container opening of a fuel container having a fuel-receiving chamber, with the main container opening permitting liquid fuel to flow into and out of the fuel-receiving chamber. The flame mitigation device comprises a sidewall defining a plurality of perforations through which the liquid fuel can flow to dispense such liquid fuel from the fuel-receiving chamber when the flame mitigation device is installed within the fuel container. At least a portion of the perforations defined in the sidewall are downwardly sloping perforations, with the downward angle of the downwardly sloping perforations being at least 1 degree below horizontal. And at least 20 percent of the total open area defined by all of said perforations is attributable to downwardly sloping perforations.

7 Claims, 18 Drawing Sheets

(56) References Cited

U.S. PATENT DOCUMENTS

| | | | | |
|---|---|---|---|---|
| 8,567,646 | B1 | 10/2013 | Cray | |
| 8,602,273 | B2 | 12/2013 | Carter | |
| 2009/0242556 | A1 | 10/2009 | Pearlstein | |
| 2011/0036763 | A1 | 2/2011 | Santinon | |
| 2013/0087581 | A1 | 4/2013 | Jensen | |
| 2015/0001217 | A1* | 1/2015 | Cray | A62C 3/065 220/88.2 |
| 2015/0352946 | A1* | 12/2015 | Karlsson | B60K 15/0403 220/562 |
| 2016/0123477 | A1* | 5/2016 | Eilers | F16K 1/54 137/601.18 |

* cited by examiner

FLAME MITIGATION DEVICE FOR PORTABLE FUEL CONTAINERS

CROSS REFERENCE TO RELATED APPLICATIONS

This application claims priority benefit of U.S. Provisional Patent Application No. 62/456,456, filed Feb. 8, 2017. The entire disclosure of the above-identified provisional patent application is incorporated herein by reference herein.

BACKGROUND OF THE INVENTION

1. Field of the Invention

The present invention concerns a flame mitigation device for portable containers, which are configured to hold and dispense flammable liquid fuels. More particularly, embodiments are concerned with a flame mitigation device, which is configured to allow liquid fuel to pass through at a rate sufficient to prevent spillage during filling at standard gas pump flow rates and to inhibit explosions by retaining fuel sufficient to provide a fuel-air mixture that is too rich to support combustion.

2. Description of the Prior Art

Portable fuel containers as used herein are intended to refer to containers which hold about 6 gallons (about 26.43 liters) or less of fuel. Such portable fuel containers have traditionally been constructed of metal or synthetic resin and configured to permit stored fuel to be dispensed from an opening for use. Existing portable fuel containers are safe and effective for their intended purpose when properly used. Unfortunately, notwithstanding warning labels, common sense and safety instruction, as well as the experiences of others, users are known to have improperly used fuel containers. Bad judgment or practically no judgment is occasionally exercised by those users who ignore safe practices and instead recklessly pour liquid fuel from a portable container into a smoldering campfire or brush pile, or even onto an open flame. The resulting consequences are predictable but tragic when the fuel which is being poured and the fuel vapors ignite and burns the user and others in the vicinity of the fuel container.

Most children are taught at a young age that fire or explosion may result from a combination of fuel (e.g., gasoline or other inflammable liquids), oxygen (such as is present in the atmosphere) and a source of ignition. Most safety measures concentrate on eliminating one of these elements. Thus, modern EPA approved portable fuel containers include warnings and provide closures that enclose the fuel container to shut off the source of fuel. These fuel containers work well under normal circumstances where the user exercises even a minimum of care. It is believed that even under conditions of abuse as described herein, fuel containers of recent manufacture will not explode. However, explosions within fuel containers have been induced by researchers in highly-controlled, extreme laboratory environments. While it is believed that it is only possible to produce an explosion within a fuel container under such extreme laboratory conditions, there has developed a need for a new approach to inhibiting combustion within portable fuel containers.

Attempts have been made to eliminate the possibility of portable fuel container explosions. Some portable fuel containers made of metal (specifically safety cans) employ a metal flame arrestor. A flame arrestor is a metal screen that is fitted inside the neck of the tank and attempts to keep an ignition source such as a flame or spark from entering the tank of the portable fuel container. While such flame arrestors may be beneficial in a safety can, there are difficulties using them in common plastic fuel containers. For example, while filling a portable fuel container at a gas station, pumping gasoline through a flame arrestor screen could cause the fuel to splash back out of the container and mix with air, thereby creating a mixture ready for combustion. Moreover, pumping gasoline through a metal screen may cause a static spark with obvious catastrophic consequences. Metal safety cans offer a grounding tab to prevent this static electricity discharge, but this is not possible nor practical in a synthetic resin (plastic) tank as ordinary consumers are not familiar with this apparatus or practice. Furthermore, the presence of a metal flame arrestor may give the user a false sense of security or safety to the consumer and user and, if positioned just inside the neck of the container (as they are in such metal safety cans) they can be easily removed, thus defeating the intent of protecting against even irresponsible use.

Thus, while the use of existing flame arrestors may have benefits, its limitations, especially in the context of use in a synthetic resin portable fuel container, still presents problems and far outweigh any benefits. A flame arrestor's intent is to keep the flame or spark from entering a portable fuel container, but this may not prove sufficient to defeat combustion when a user removes the flame arrestor or pours fuel directly onto fire.

Some attempted solutions for the aforementioned problems have been further complicated when liquid fuel cannot be received in the fuel container at a fast-enough rate to prevent spillage during filling at standard gas pump flow rates. Moreover, it has heretofore been difficult to securely couple previously-used flame arrestors, or other flame mitigation devices, to the fuel container.

SUMMARY OF THE INVENTION

The present invention employs a method and apparatus which run contrary to conventional thinking, in that rather than cutting off a source of liquid fuel or ignition sources, an overly rich fuel-to-air ratio is provided within the portable fuel container, thus preventing the possibility of combustion.

As noted above, it is accepted scientific fact that when fuel and air are present and their mixture is within a given combustible range, combustion will occur if the mixture is ignited. If the mixture of fuel and air is perfect (a stoichiometric mixture), complete combustion is achieved and both the fuel and the air are totally consumed during the combustion event. Combustion may also occur if the mixture is slightly lean of fuel, but if too lean (i.e., not enough fuel is present) combustion cannot occur. Similarly, combustion may occur if the mixture has slightly more fuel than a stoichiometric mix, but if the fuel-air mixture has too much fuel (becoming too rich), combustion cannot occur in this condition either.

The present invention seeks to employ this latter circumstance—a situation where the fuel-air mixture is too rich—to inhibit combustion within the portable fuel container where, for example, fuel is being poured directly from the container opening onto an ignition source or within a controlled laboratory where fuel is "weathered" and maintained at an artificial temperature to establish a condition ripe for explosion. Again, the former circumstance is a highly undesirable practice which poses extreme risks to the user and others and should be avoided at all times, and the latter occurs only artificially when one intends to produce combustion within a container. The present invention seeks to minimize the risk of combustion in the portable fuel container even where the user proceeds recklessly or explosion is an intended consequence.

The method and apparatus of the present invention employs structure which will be unlikely to be removed by an imprudent user because it does not impede normal usage, yet retains a sufficient quantity of fuel within the portable fuel container so as to create a mixture too rich to combust. Where there is sufficient fuel present in the container to present a risk of explosion when the contents are being poured, the present invention uses this condition to its advantage by trapping a sufficient quantity of fuel and thereby creates a "too rich" condition to inhibit combustion within the container. In some preferred embodiments, the structure of the apparatus and the method seek to cause this condition to be maintained in close proximity to the opening such that combustion may not proceed into the interior of the container but rather any explosive event will be suppressed by the retention of fuel immediately proximate the opening. In this circumstance, an incipient explosion entering the portable fuel container will encounter a circumstance where the amount of fuel in the fuel-air mixture will not support combustion.

The present invention contemplates several alternate structures for providing this condition. In one approach, a neck dam is positioned in a neck of the portable container interior to the opening whereby a sufficient quantity of fuel is trapped in the neck area during pouring of fuel from the opening. In another approach, an absorbent, sponge-like material is utilized within the interior of the container either within a main body or in the neck proximate to an opening in the container. The absorbent material, by becoming substantially saturated and retaining a quantity of fuel in the area of the neck once fuel is poured therefrom, provides a "too rich" mixture for combustion and the onset of an explosion. In another approach, the container is configured to provide an inverted pocket for retaining fuel adjacent the neck area, the pocket retaining sufficient fuel during pouring from the container to provide a fuel-air mixture too rich to support combustion. A further approach is to provide a flash suppressor which is integral to the neck or tank walls and extends into the fuel-receiving chamber of the container, which accommodates the introduction of fuel into the container from a conventional gasoline pump nozzle, includes a substantially imperforate fuel-retaining wall to create a fuel-retaining pocket adjacent the opening in the container which fuel-retaining wall extends part way into the fuel-receiving chamber, and includes perforations to permit fuel to flow therethrough for filling the container and dispensing fuel therefrom. Each of these alternative structures is employed to retain a sufficient quantity of fuel within the container, and in particular in the narrowed neck area such that the fuel-air mixture is too rich to support combustion entering and/or occurring into the interior of the tank portion of the portable fuel tank—even combustion which may be occurring in the environment just exterior to the opening.

The present invention also contemplates some embodiments of the flash suppressor, also referred to herein as a flame mitigation device, may comprising a cylindrical sidewall presenting a plurality of perforations extending through the sidewall. In some embodiments, the perforations are configured in such a manner that the flame mitigation device can retain a quantity of liquid fuel that is too rich to support combustion, even after the liquid fuel has been dispensed from the fuel container and/or after the flame mitigation device is no longer submerged in the liquid fuel. In some embodiments, the perforations may slope downwardly as they extend from an inner surface of the sidewall to an outer surface of the sidewall. Such downward sloping perforations facilitate liquid fuel to pass through the flame mitigation device at a fast-enough rate to prevent spillage during filling at standard gas pump flow rates.

In more detail, the flame mitigation device may be configured to be located proximate a main container opening of a fuel container, with the main container opening permitting flow of a liquid fuel into and out of a fuel-receiving chamber of the fuel container. The flame mitigation device comprises a sidewall defining a plurality of perforations through which liquid fuel flows to dispense liquid fuel from the fuel-receiving chamber. The flame mitigation device may be formed of a synthetic resin material. The flame mitigation device may have an internal volume of at least 2 cubic inches. The flame mitigation device may be at least 10 percent open. The average open area of the perforations may not be more than 0.05 square inches. At least a portion of the perforations defined in the sidewall may be downwardly sloping perforations, with a downward angle of the downwardly sloping perforations being at least 1 degree below horizontal. And at least 20 percent of the total open area defined by all of the perforations may be attributable to downwardly sloping perforations.

Other embodiments of the present invention may include a fuel container comprising a hollow tank body defining a fuel-receiving chamber and a main container opening for permitting flow of a liquid fuel into and out of the fuel-receiving chamber. The fuel container may additionally comprise a fuel dispensing assembly coupled to the tank body proximate the main container opening and configured to dispense the liquid fuel from the container. The fuel container may further comprise a fuel retention structure located proximate the main container opening and extending generally downwardly into the fuel-receiving chamber. The fuel retention structure may comprise a plurality of perforations through which the liquid fuel must flow in order to dispense the liquid fuel from the container. The fuel retention structure may be configured to retain a quantity of the liquid fuel in the chamber when the container is tipped or inverted to dispense the liquid fuel therefrom. The retained quantity of the liquid fuel may be sufficient to provide a fuel-air mixture proximate to the main container opening that is too rich to support combustion. The fuel retention structure may comprise a sidewall defining a plurality of the perforations, with at least a portion of the perforations defined in the sidewall being downwardly sloping perforations. The downward angle of the downwardly sloping perforations may be at least 1 degree below horizontal. And at least 20 percent of the total open area defined by all of said perforations may be attributable to downwardly sloping perforations.

In some embodiments, the flame mitigation device may also be provided with one or more wing elements that extend from the sidewall and that are configured to inhibit the flame mitigation device from being removed from a main opening of a fuel container. In particular, the wing elements may be configured to compress towards the sidewall as the wing elements pass through the main opening, and expand away from the sidewall after the wing elements have passed through at least a portion of the main opening. Once the wings have sufficiently passed the main opening and expanded, the wing elements can inhibit the flame mitigation device from being removed from the main opening of the fuel container.

In more detail, embodiments include a method for coupling a flame mitigation device to a fuel container, with the fuel container comprising a hollow tank body defining a fuel-receiving chamber and a main container opening for permitting flow of a liquid fuel into and out of the fuel-receiving chamber. The method comprises a step of providing the flame mitigation device comprising a sidewall defining a plurality of perforations through which liquid fuel is required to flow to dispense liquid fuel from the fuel-receiving chamber of the fuel container. The flame mitigation device further comprises wing elements extending from the sidewall. The method includes an additional step of inserting the flame mitigation device through the main container opening of the fuel container. During the inserting step, the wing elements are compressed to a position adjacent to an outer surface of the sidewall. The method further comprises the step of securing the flame mitigation device within the main container opening of the fuel container. During said securing step, the wing elements expand away from the outer surface of the sidewall.

DETAILED DESCRIPTION OF EXEMPLARY EMBODIMENTS

The following detailed description of embodiments of the invention references the accompanying figures. The embodiments are intended to describe aspects of the invention in sufficient detail to enable those with ordinary skill in the art to practice the invention. The embodiments of the invention are illustrated by way of example and not by way of limitation. Other embodiments may be utilized and changes may be made without departing from the scope of the claims. The following description is, therefore, not limiting. It is contemplated that the invention has general application to validating payment transactions made using payment network systems. However, the scope of the present invention is defined only by the appended claims, along with the full scope of equivalents to which such claims are entitled.

In this description, references to "one embodiment," "an embodiment," or "embodiments" mean that the feature or features referred to are included in at least one embodiment of the invention. Separate references to "one embodiment," "an embodiment," or "embodiments" in this description do not necessarily refer to the same embodiment and are not mutually exclusive unless so stated. Specifically, a feature, component, action, operation, etc. described in one embodiment may also be included in other embodiments, but is not necessarily included. Thus, particular implementations of the present invention can include a variety of combinations and/or integrations of the embodiments described herein. Like reference numbers are used to identify the same or similar structures in the different embodiments and views.

Figure 1:
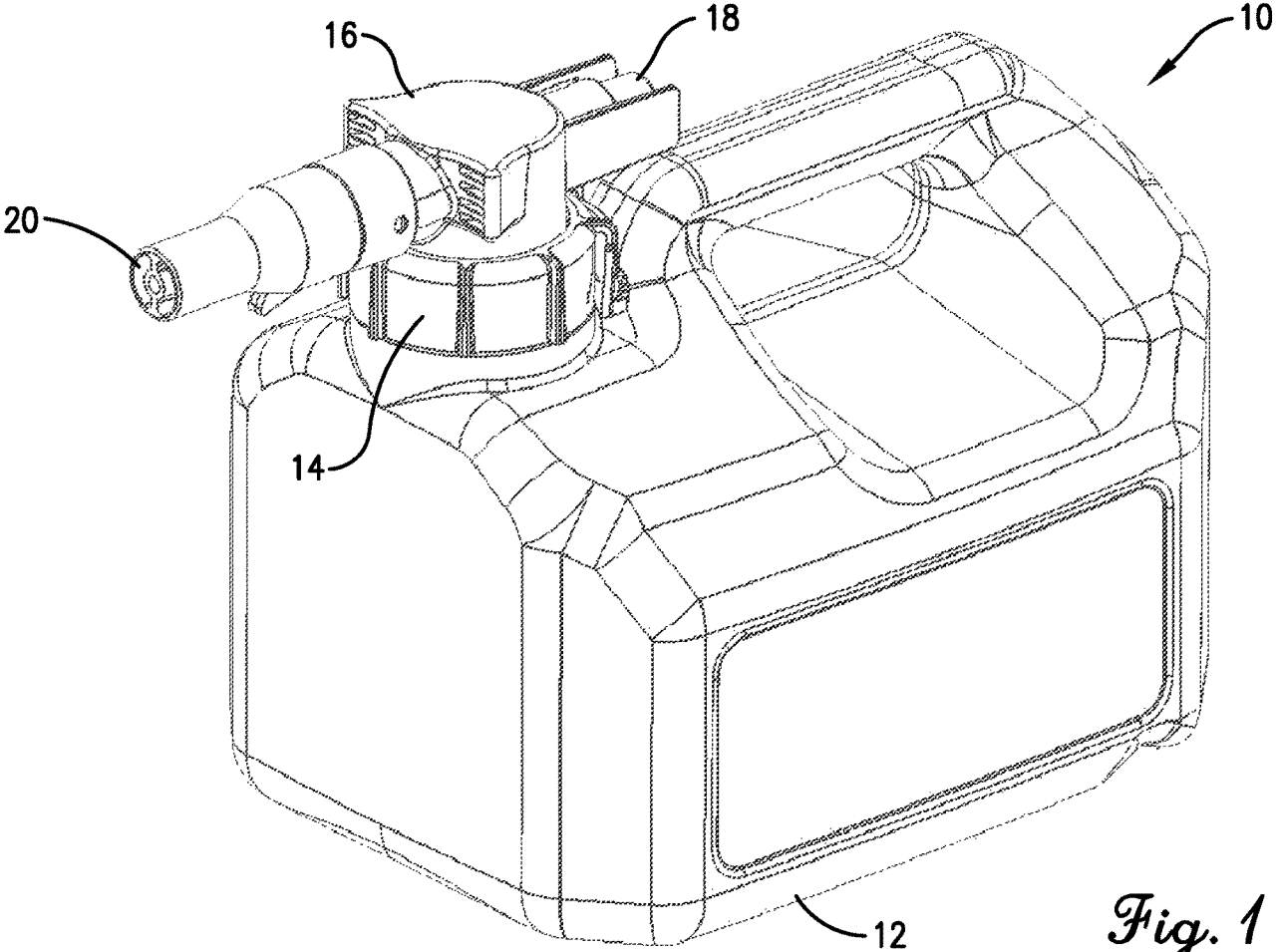
FIG. 1 is a perspective view of a portable fuel container having a hollow tank body, and a fuel dispensing nozzle mounted to a neck.

Referring now to the drawings, FIG. 1 shows a portable fuel container 10. The fuel container 10 is shown as an example of the variety of different fuel containers with which the present invention may be employed, it being understood that the present invention is not limited to the particular fuel container 10 as shown herein. The fuel container 10 includes a hollow tank body 12, a collar 14 which is removably mounted to the fuel container 10 and which, in combination with a dispensing spout 16, covers an opening which may be used for filling the fuel container 10 with fuel and from which the fuel contained therein may be selectively dispensed. The dispensing spout 16 of this example is a selectively actuatable dispensing spout biased to a non-dispensing condition, such that the user must operatively depress a button 18 in order to enable fuel to flow from the tank body 12 through the dispensing spout 16 and from a discharge outlet 20. The dispensing spout 16 may be held by the collar 14 which is threadably attached to a neck 22 fluidically communicating with the tank body 12, the external threading on the neck 22 being shown in FIG. 2. In the example shown in FIG. 1, both the dispensing spout 16 and the collar 14 are coupled together whereby unscrewing the collar 14 causes the collar 14 and dispensing spout 16 to be detached from the container as a unit. When the dispensing spout 16 or collar 14 are removed, an opening 24 is revealed which permits filling of the tank body 12 with fuel or, in typically undesired circumstances, through which fuel contained in the tank body 12 may be poured. The size of the opening 24 can be at least at least 2.0, 2.25, 2.75, or 3.0 square inches and/or not more than 10, 8, 6, or 4 square inches. As shown in FIGS. 2-6 and 12-15, a fuel-receiving chamber 25 is presented within the body 12. The fuel-receiving chamber 25 can have a capacity of at least 1 gallon and/or not more than 6 gallons. The fuel container body 12, collar 14 and spout 16 are preferably molded of synthetic resin, such as, for example, polyethylene.

Figure 2:
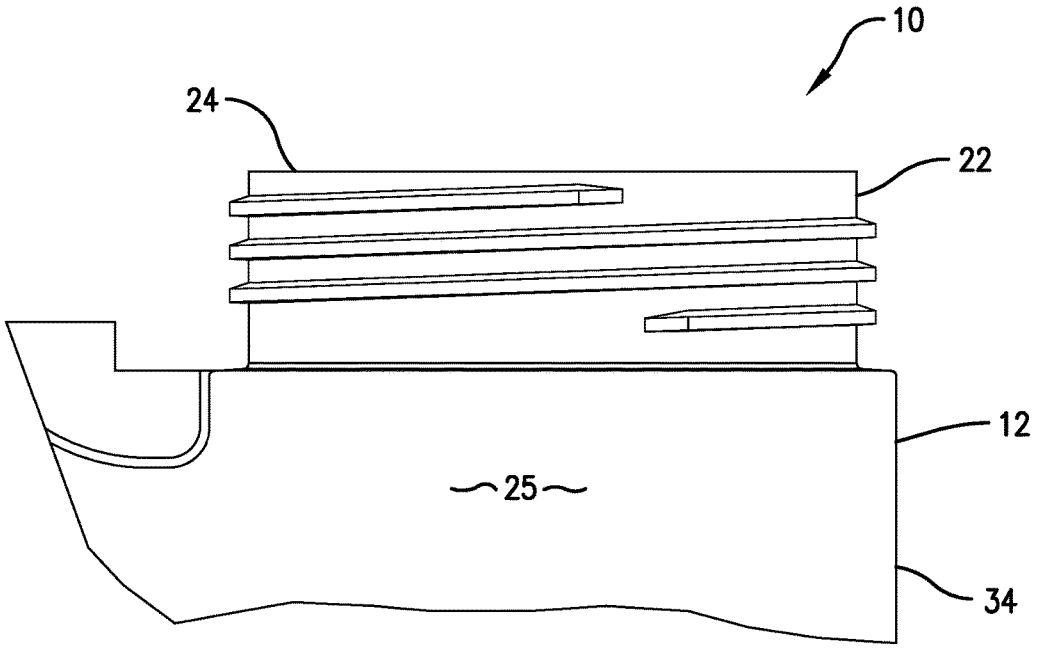
FIG. 2 is an enlarged side elevational view of a neck and opening of a portable fuel container according to the prior art, showing in vertical cross-section a part of the tank body adjacent the neck.
Figure 3:
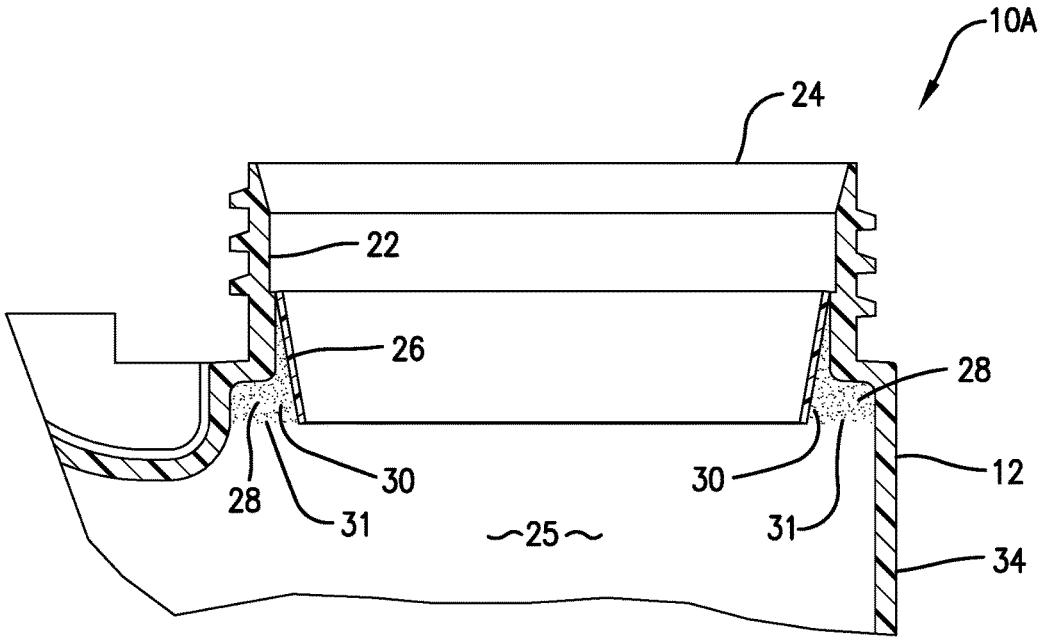
FIG. 3 is an enlarged, cross-section side elevational view of a neck and opening of a portable fuel container according to one embodiment of the present invention, utilizing an annular neck dam which is inwardly flared to retain fuel proximate the neck and opening.

A typical neck 22 of a portable fuel container 10 is shown in FIG. 2. FIG. 3 illustrates a first embodiment of the apparatus of the present invention. A portable fuel container 10A may be constructed substantially identically to that shown in FIGS. 1 and 2. However, an annular neck dam 26 of synthetic resin material such as polyethylene or polypropylene which is resistant to degradation by exposure to fuel such as gasoline is inserted into the neck 22 proximate the opening 24. As shown in FIG. 3, the annular neck dam 26 may extend around the interior surface of the neck 22 and extends downwardly toward and into the tank body 12. The annular neck dam 26 may be flexible, and flared radially inwardly. Thus, when the portable fuel container 10A is tipped or inverted, fuel 28 (shown by stippling) is retained in a reservoir 30 created by the neck dam 26 adjacent the opening 24 thereby increasing the fuel-air mixture in the vicinity of the neck 22. A generally downwardly facing reservoir opening 31 allows the fuel 28 to enter the reservoir 30 when the fuel container 10A is tipped or inverted and also allows the fuel 28 retained in the reservoir 30 during dispensing to flow back out of the reservoir 30 when the container 10A is returned to its upright position. In certain embodiments of the invention, the reservoir 30 is sized to retain at least 6 milliliters of liquid fuel per gallon of liquid capacity of the container 10. In other embodiments, the reservoir 30 is sized to retain at least 10 milliliters of liquid fuel per gallon of liquid capacity of the container 10.

Figure 4:
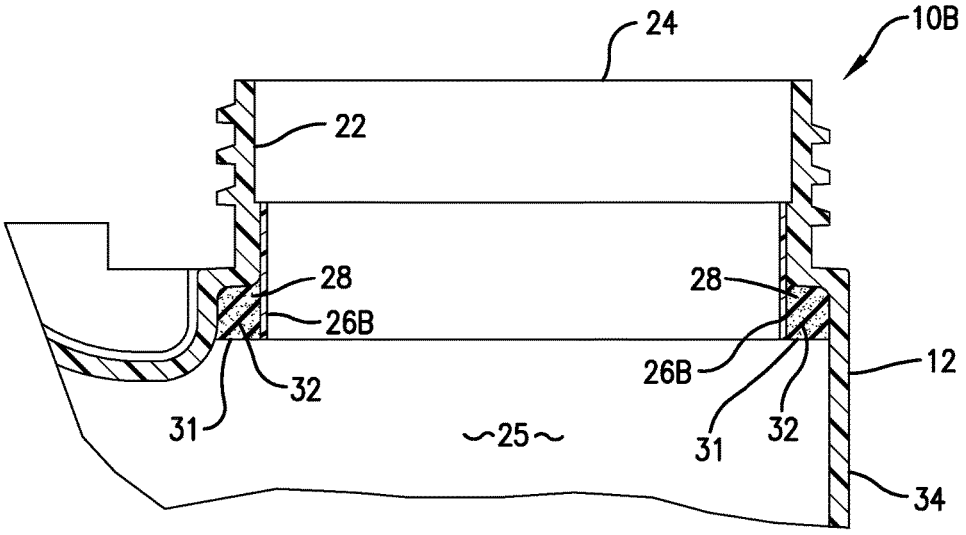
FIG. 4 is an enlarged, cross-section side elevational view of neck and opening of a portable fuel container according to another embodiment of the present invention, utilizing an annual neck dam which has a circumscribing and downwardly extending without flaring, and which retains an absorbent sponge-like material.

FIG. 4 shows an alternate embodiment of the portable fuel container 10B hereof, the portable fuel container 10B being constructed substantially the same as that shown in FIGS. 1, 2 and 3. However in FIG. 4, the annular neck dam 26B is not flared, but rather is substantially configured as a cylindrical tube fitted into the neck 22 and extending downwardly toward and into the tank body 12. An optional pad 32 of porous compressible absorbent material which is sponge-like is provided in the reservoir 30. The annular neck dam 26B may thus serve to retain the pad 32 which as shown may also be annular. Alternatively, the annular neck dam 26B may be omitted, with the pad 32 retained in position by adhesive or mechanical attachment. Fuel 28 may be retained in the reservoir 30 when the portable fuel container 10B is tipped or inverted, thereby increasing the ratio of fuel to air in the vicinity of the neck 22 and opening 24.

Figure 5:
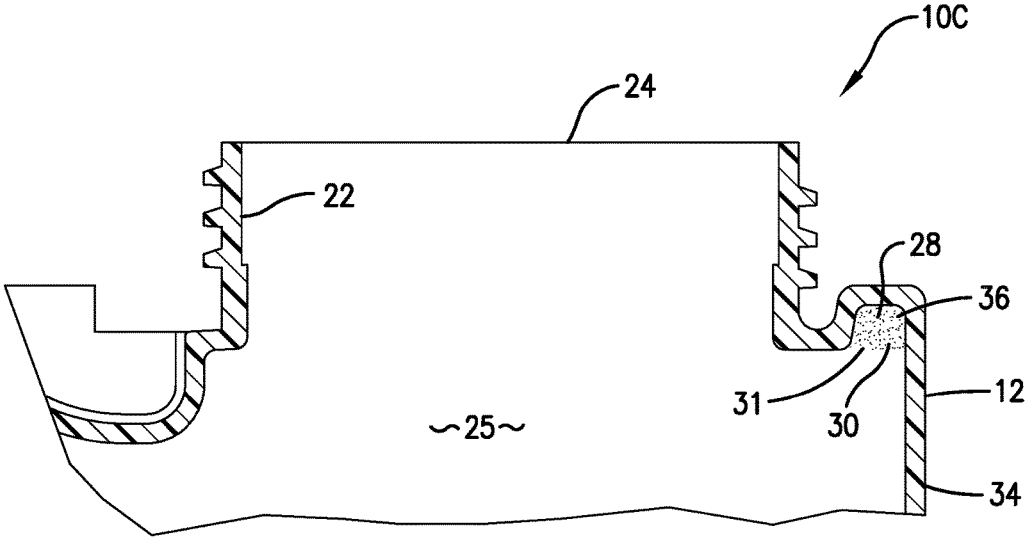
FIG. 5 is an enlarged, cross-section side elevational view of a neck and opening of a portable fuel container according to a further embodiment of the present invention, which utilizes and inverted fuel-retaining pocket adjacent the neck and opening.

FIG. 5 shows a further alternate embodiment of the portable fuel container 10C hereof. While substantially identical to the portable fuel containers shown in FIGS. 1-4, the wall 34 of the tank body 12 adjacent the neck 22 is configured with an inverted pocket 36. The pocket 36 may be constructed so that it extends completely around and thus surrounds the neck 22, or alternatively as shown in FIG. 5, may be located and configured so that it extends less than 360° around the base 38 of the neck 22. When the portable fuel container 10C is tipped or inverted, fuel 28 will be held in the pocket 36, thereby increasing the ratio of fuel to air in the vicinity of the neck 22.

Figure 6:
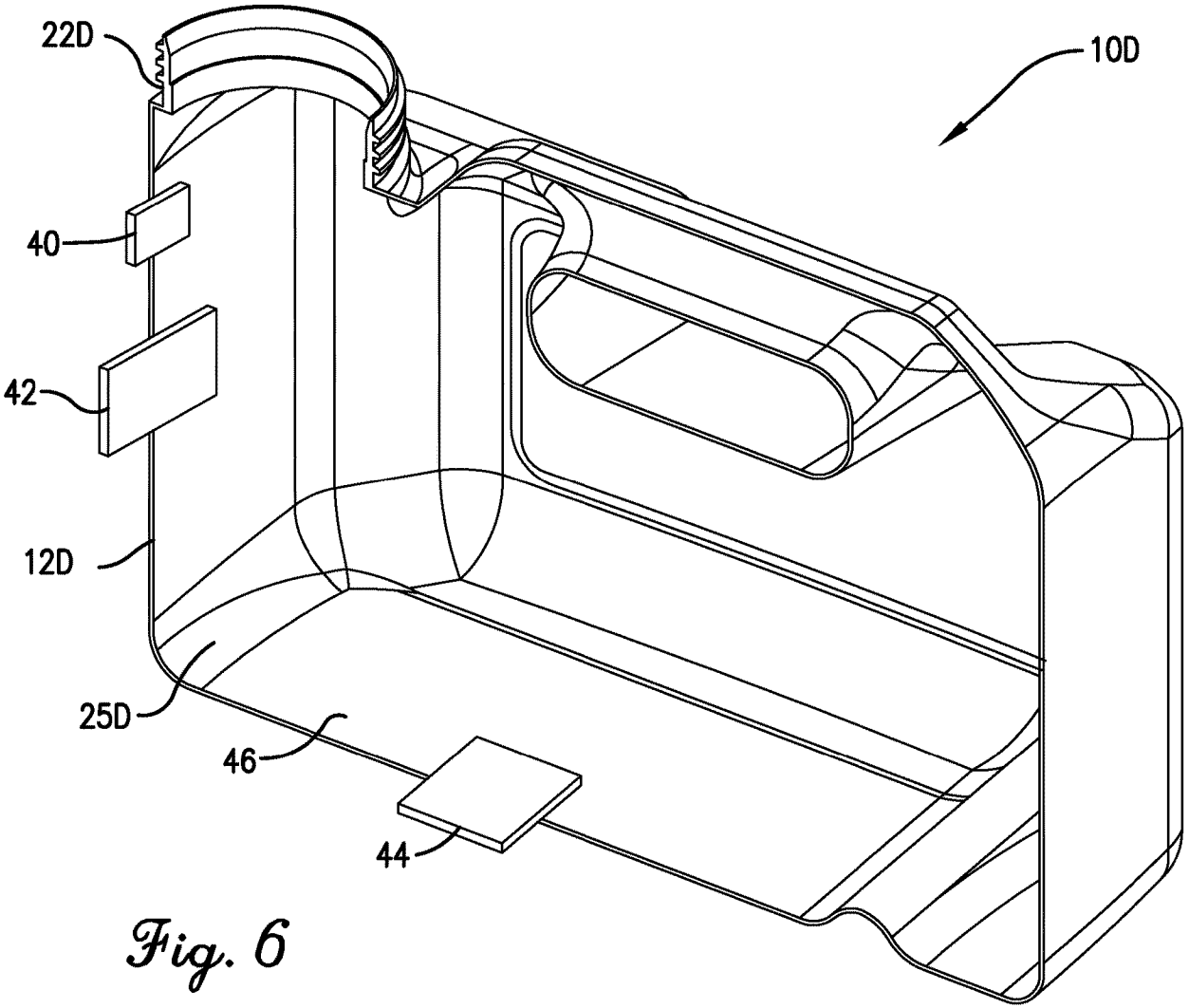
FIG. 6 is an isometric view of a vertical section through a portable fuel container as shown in FIG. 1 with the fuel dispensing nozzle removed and showing a plurality of absorbent pads mounted interiorly of the main body for absorbing and retaining fuel within the portable fuel container.
Figure 7:
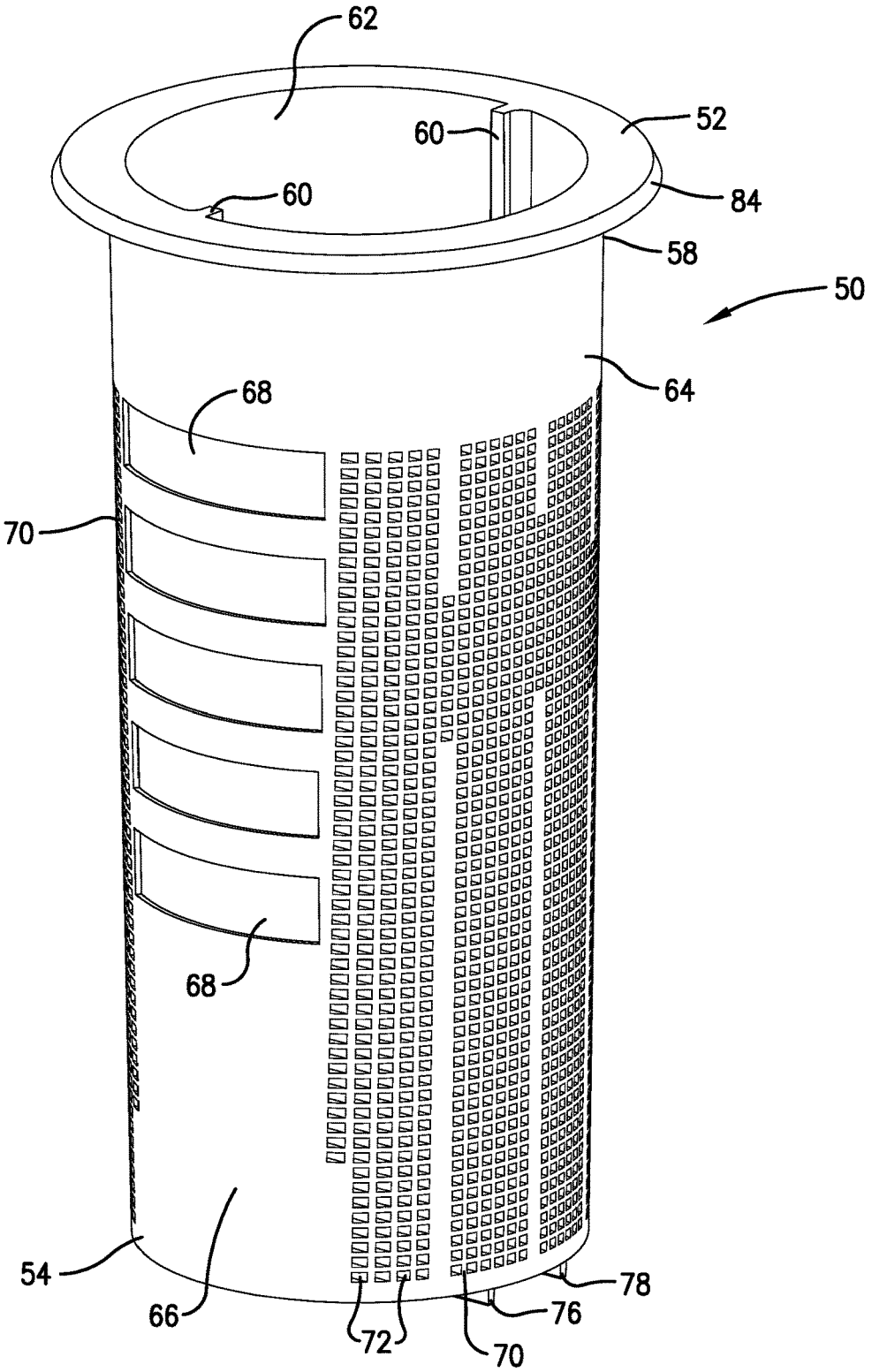
FIG. 7 is an isometric view of a flash suppressor for integrating inside the neck of a portable fuel container and having a fuel-retaining wall for creating a fuel-retaining pocket proximate the neck and opening of a fuel container.

FIG. 6 shows a yet further alternate embodiment of the fuel container 10D hereof. FIG. 6 shows the tank body 12D and neck 22D in cross-section, with the opening enclosed but with the understanding that in practice the neck 22D would be open so that fuel could flow into the chamber 25D through an opening in the neck 22D. It is to be understood that the neck 22D would be externally threaded to receive the dispenser 16 shown in FIG. 1, and could have the neck dam or inverted pocket as illustrated in FIGS. 2-5. FIG. 6, however, also shows the use of absorbent pads 40, 42 and 44 attached to the inside surface 46 of the tank body 12D. It is contemplated that only one such absorbent pad would be used per fuel container, but it is possible that a plurality of such pads 40, 42 and 44 could be used simultaneously. While the absorbent pads could be movable or even loose within chamber 25D and still retain sufficient fuel to inhibit an explosion event within the portable fuel container 10D, it is believed that better operating characteristics such as avoiding potential blockages at the opening will be achieved by mounting the pads 40, 42 and 44 to the inside surface 46 using mechanical fasteners or adhesive or bonding the pads to the inside surface 46 of the portable fuel container 10D. Like pad 32, the pads 40, 42 and 44 are preferably porous compressible absorbent material which is sponge-like, for example synthetic resin open-celled foam material. Fuel 28 is thus retained by the pads 40, 42 and 44 to create a mixture too rich for combustion and explosion.

FIGS. 7 through 15 show a flash suppressor 50 that can be integrated into a portable fuel container 10E. The flash suppressor 50 may have an annular rim 52, a generally cylindrical, conical, or frustoconical suppressor sidewall 54, and a bottom wall 56. The flash suppressor 50 can be injection molded from a synthetic resin material such as polyethylene to be compatible with the tank body. The suppressor sidewall 54 may slightly taper inwardly from its width at the rim 52 to the bottom wall 56 to facilitate molding, for example from between about 0.5° to about 2.5° and most preferably about 1° of taper. The annular rim 52 surrounds an open area into which a gas nozzle may be inserted and may project outwardly from an upper end 58 of the suppressor sidewall 54 a sufficient distance to engage an inner surface of the neck of the portable fuel container into which it is received. The suppressor sidewall 54 may be provided with axially extending ribs 60 along an interior surface 62 of the suppressor sidewall 54. These ribs 60 may extend substantially from the annular rim 52 to the bottom wall 56 to resist wear from the insertion of gasoline nozzles therein or deformation.

As shown in FIGS. 7, 10-15, the suppressor sidewall 54 can include a circumferentially extending imperforate fuel-retaining wall 64 that retains some of the fuel held in the chamber 25 when the portable fuel container is tipped or inverted to position the opening 24 below the level of fuel held within the chamber 25. The fuel-retaining wall 64 can extend axially downwardly from the upper end 58 of the sidewall 54. In certain embodiments, the fuel-retaining wall 64 extends completely around the circumference of the sidewall and is continuous with the annular rim 52 so that fuel cannot pass between the fuel-retaining wall 64 and the rim 52. The fuel-retaining wall 64 extends axially a sufficient distance to retain a quantity of fuel sufficient to make the fuel-air mixture adjacent the neck too rich for ignition, depending on the capacity of the container. By way of example, the imperforate fuel-retaining wall 64 may extend axially downward from the rim 52 at least about 0.25 inch, at least about 0.5 inch, or at least about 1 inch. The suppressor sidewall 54 may also include a pair of circumferentially spaced axially extending imperforate sections 66 having radially offset (relative to the remainder of the imperforate section) axially spaced circumferentially oriented bands 68 to provide rigidity, and a pair of circumferentially spaced axially extending perforate sections 70 which include an array of perforations 72 sized to permit the flow of fuel, such as liquid gasoline, and air therethrough.

The suppressor sidewall 54 preferably extends downwardly to position the bottom wall 56 a sufficient distance to permit insertion of a gasoline pump nozzle past the neck 22 and into the area interior of the suppressor sidewall 54. In certain embodiments, the flash suppressor 50 extends at least 0.5, 1, 2, or 3 inches and/or not more than 12, 8, or 6 inches downwardly into the liquid-receiving chamber 25. Further, the flash suppressor 50 can have an internal volume (e.g., the volume of the space defined between the sidewall 54 and above the bottom wall 56) of at least 0.5, 1, 2, or 3 cubic inches and/or not more than 20, 15, 10, or 5 cubic inches.

Figure 8:
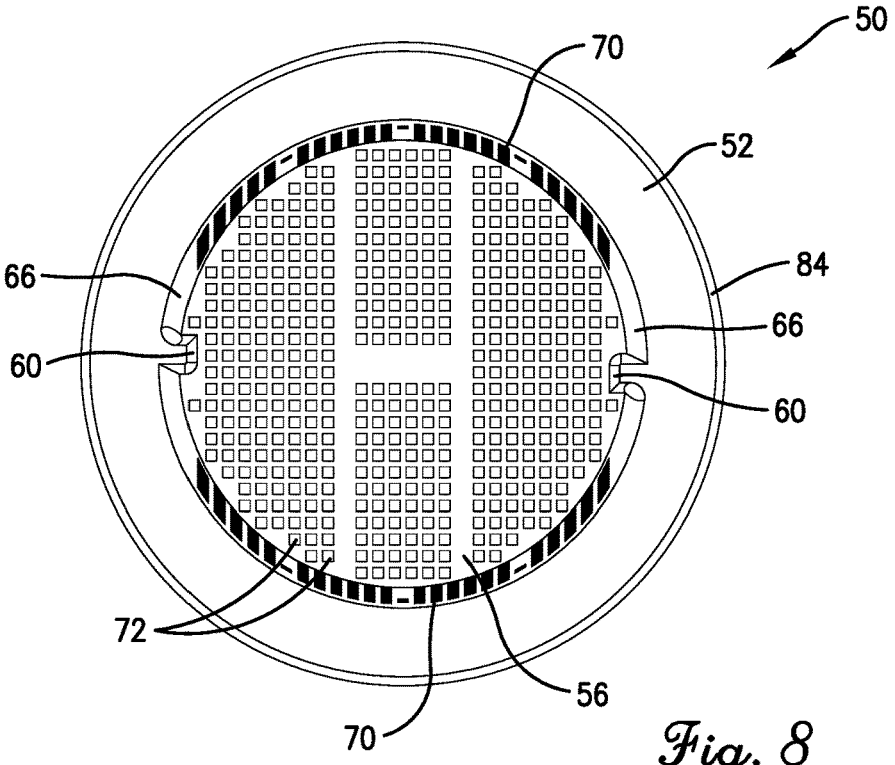
FIG. 8 is a plan view of the flash suppressor of FIG. 7 showing an annular rim configured for engaging the inner surface of the neck of the fuel container.
Figure 9:
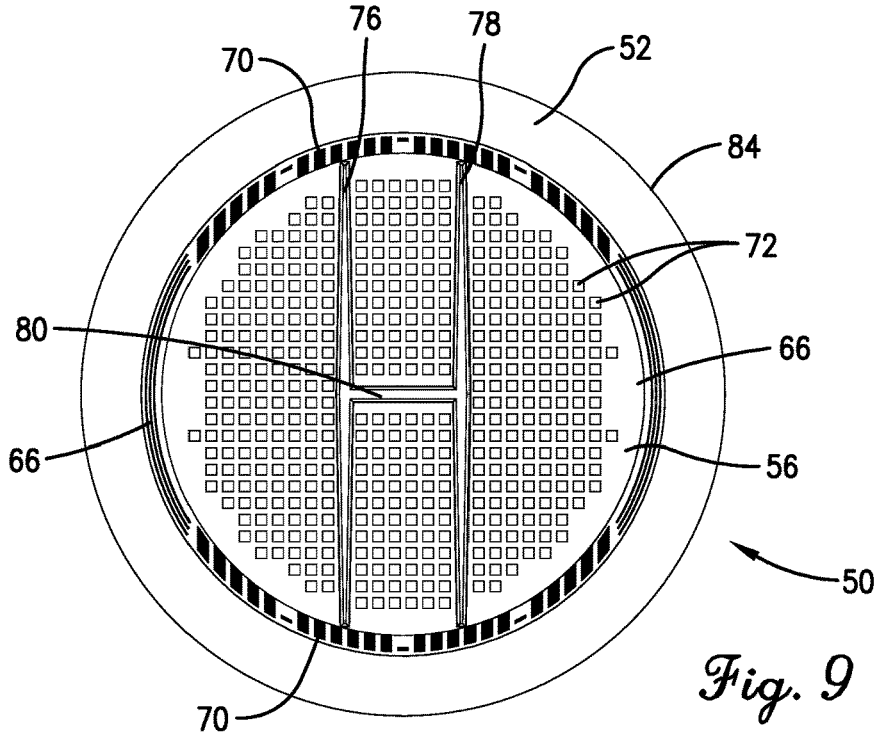
FIG. 9 is a bottom view of the flash suppressor of FIG. 7 showing perforations in the bottom wall of the flash suppressor for permitting fuel to pass therethrough.
Figure 10:
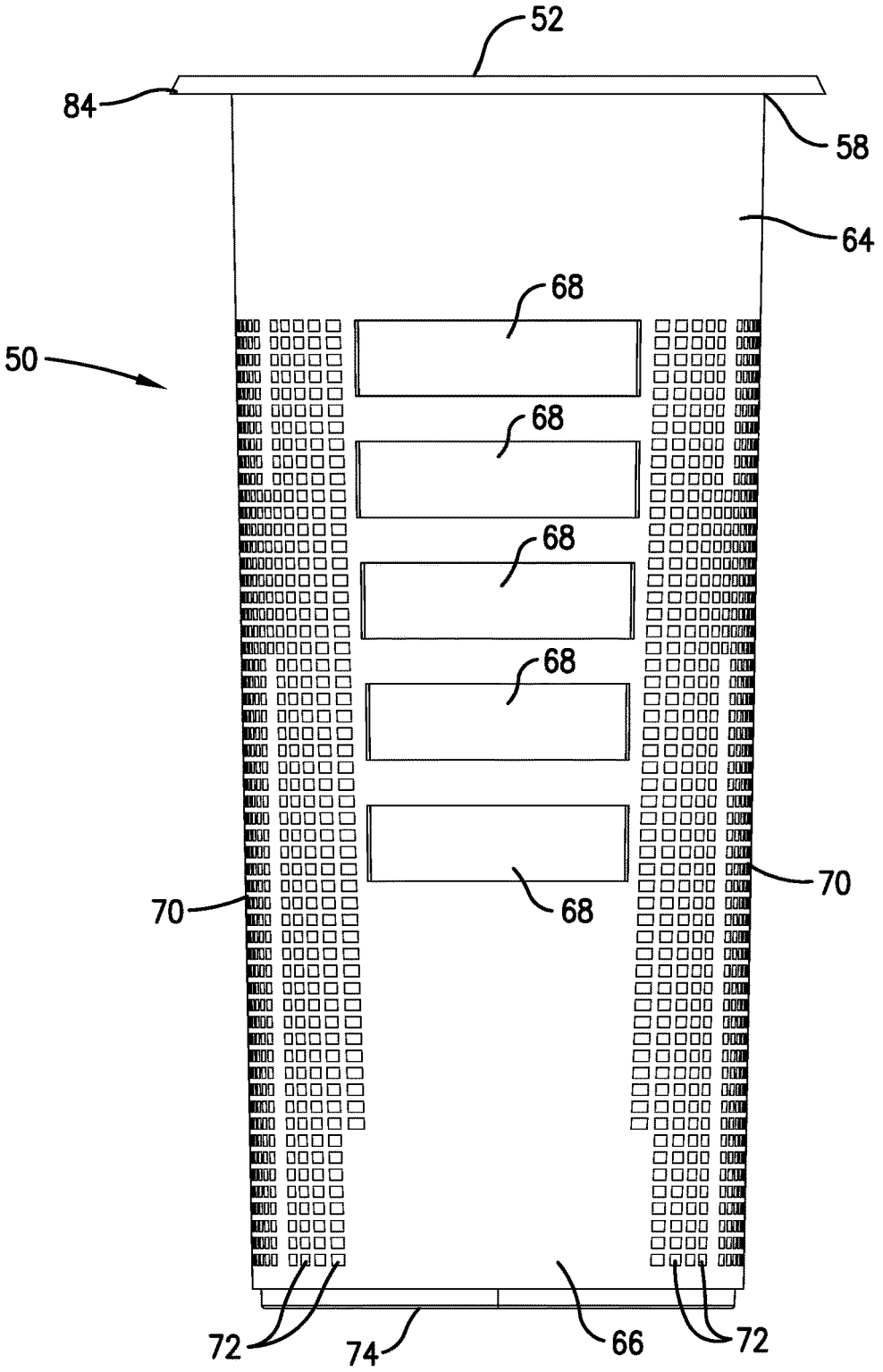
FIG. 10 is a front elevation view of the flash suppressor of FIG. 7 showing the annular rim in profile and the fuel-retaining wall adjacent the rim, the rear view being a mirror image thereof.
Figure 11:
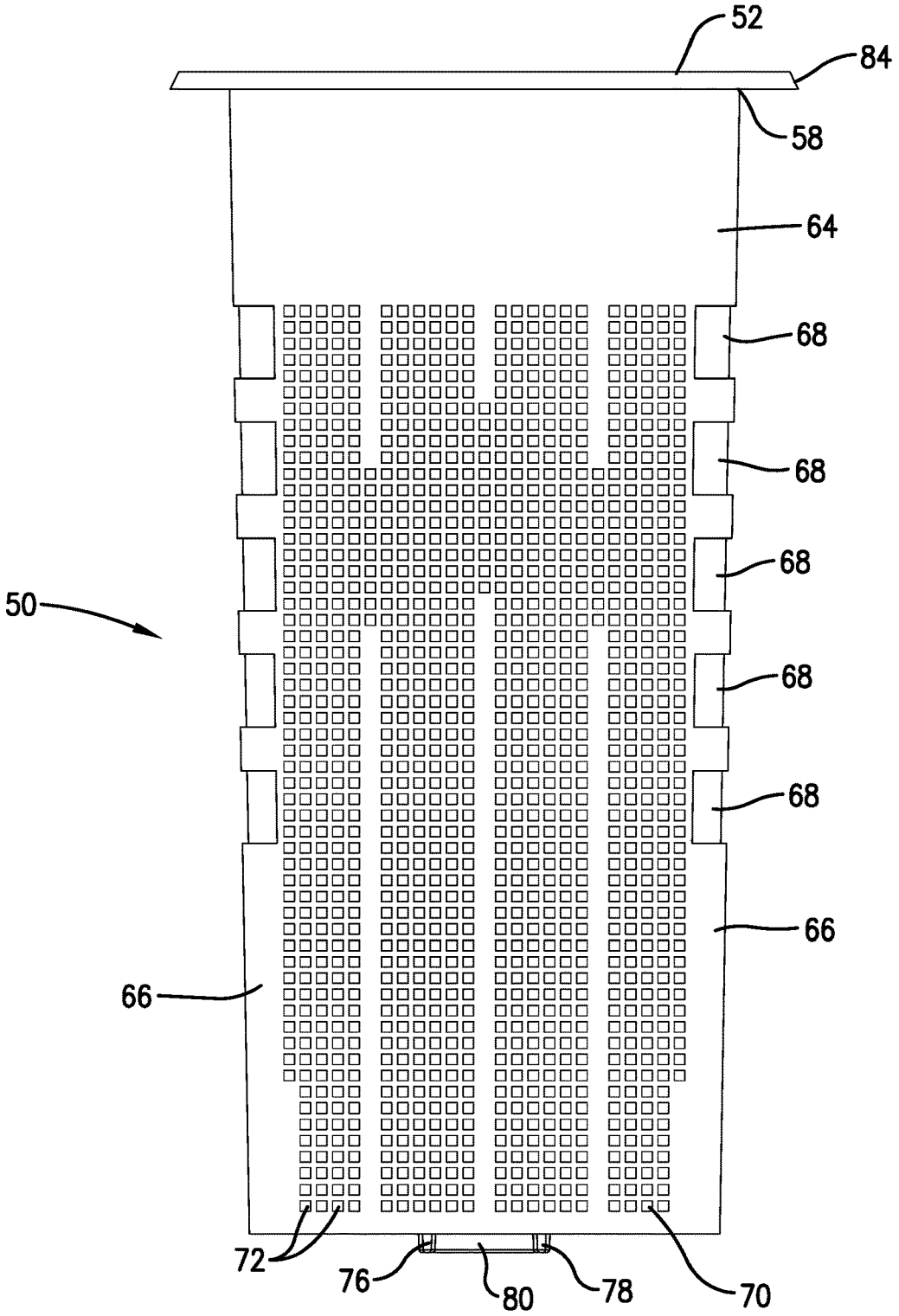
FIG. 11 is right side elevation view of the flash suppressor of FIG. 7 showing perforations in the sidewall of the flash suppressor below the fuel-retaining wall, the left side elevation being a mirror image thereof.

The bottom wall 56 of the flash suppressor 50, seen best in FIGS. 8 and 9, may include transverse reinforcement 74 in a generally H shape including downwardly extending transverse flanges 76 and 78 and connecting flange 80. The bottom wall 56 can include a plurality of perforations 72 which are sized to permit fuel such as liquid gasoline and air to flow therethrough. The number of perforations 72 and their size and positioning in the bottom wall 56 and suppressor sidewall are preferably sufficient to permit normal filling of the container at a moderate rate of flow without buildup and overflow of fuel from the container. For example, in certain embodiments, the size and positioning of the perforations 72 in the flash suppressor 50 permit at least 5, 7.5, or 10 gallons per minute of gasoline to flow therethrough under common gasoline filling conditions (e.g., atmospheric pressure and room temperature). In order to permit proper flow of liquid fuel through the flash suppressor 50, the side and lower members (e.g., sidewall 54 and bottom wall 56) can be at least 5, 10, 15, 20, or 25 percent open and/or not more than 80, 70, 60, or 50 percent open, where "percent open" is the cumulative open area of all the perforations expressed as a percentage of the total internal surface area of the side and lower members of the flash suppressor. Further, each perforation can be sized to present an open area of not more than 0.1, 0.05, 0.025, or 0.015 square inches.

Figure 12:
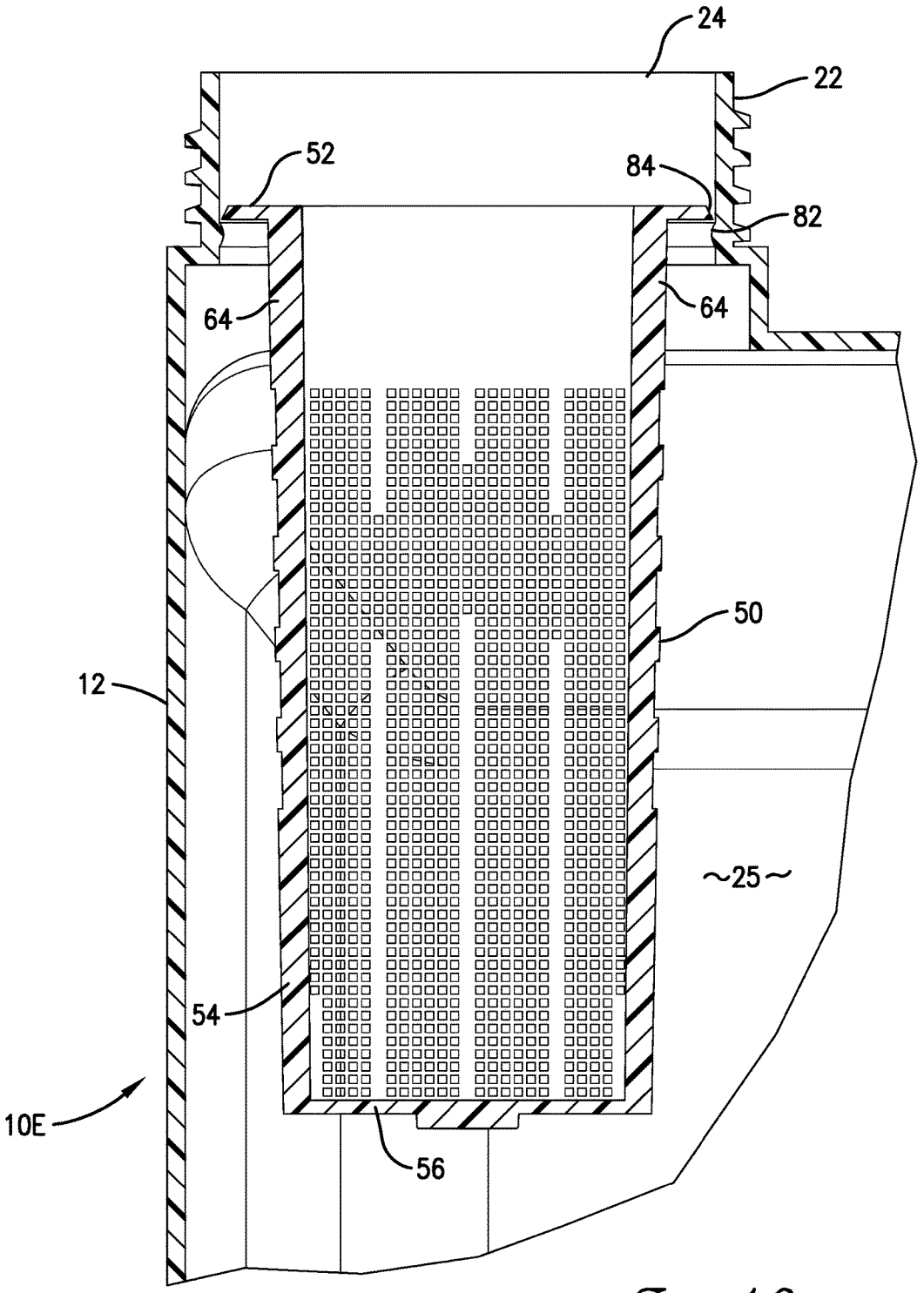
FIG. 12 is an enlarged left side elevation view of the flash suppressor of FIG. 7 placed within the neck of a fuel container prior to integration into the neck.
Figure 13:
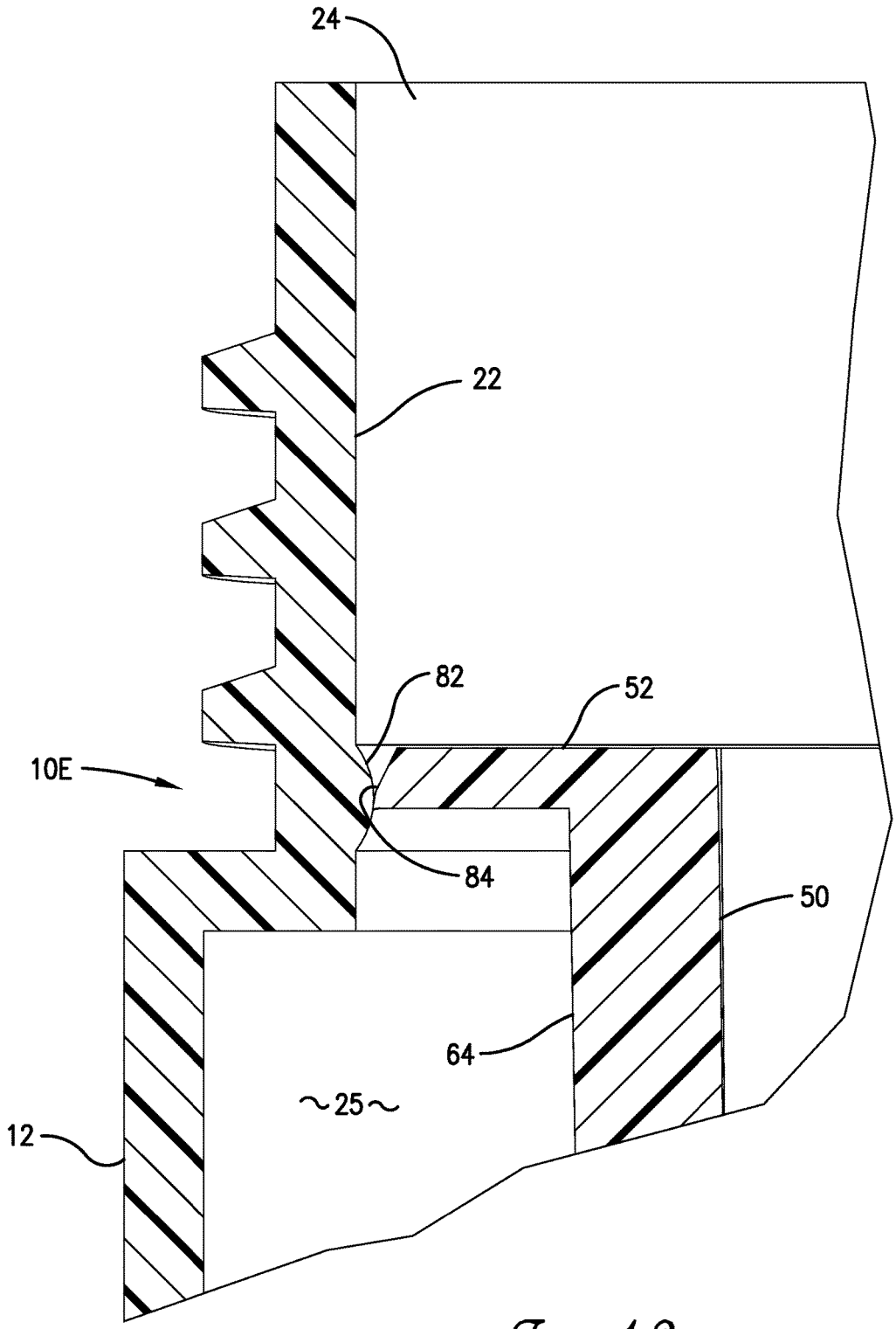
FIG. 13 is an enlarged left side elevation view showing the interference of the annular rim of the flash suppressor of FIG. 7 with a circumscribing bulge located on the inner surface of the neck of the fuel container prior to integration into the neck.
Figure 14:
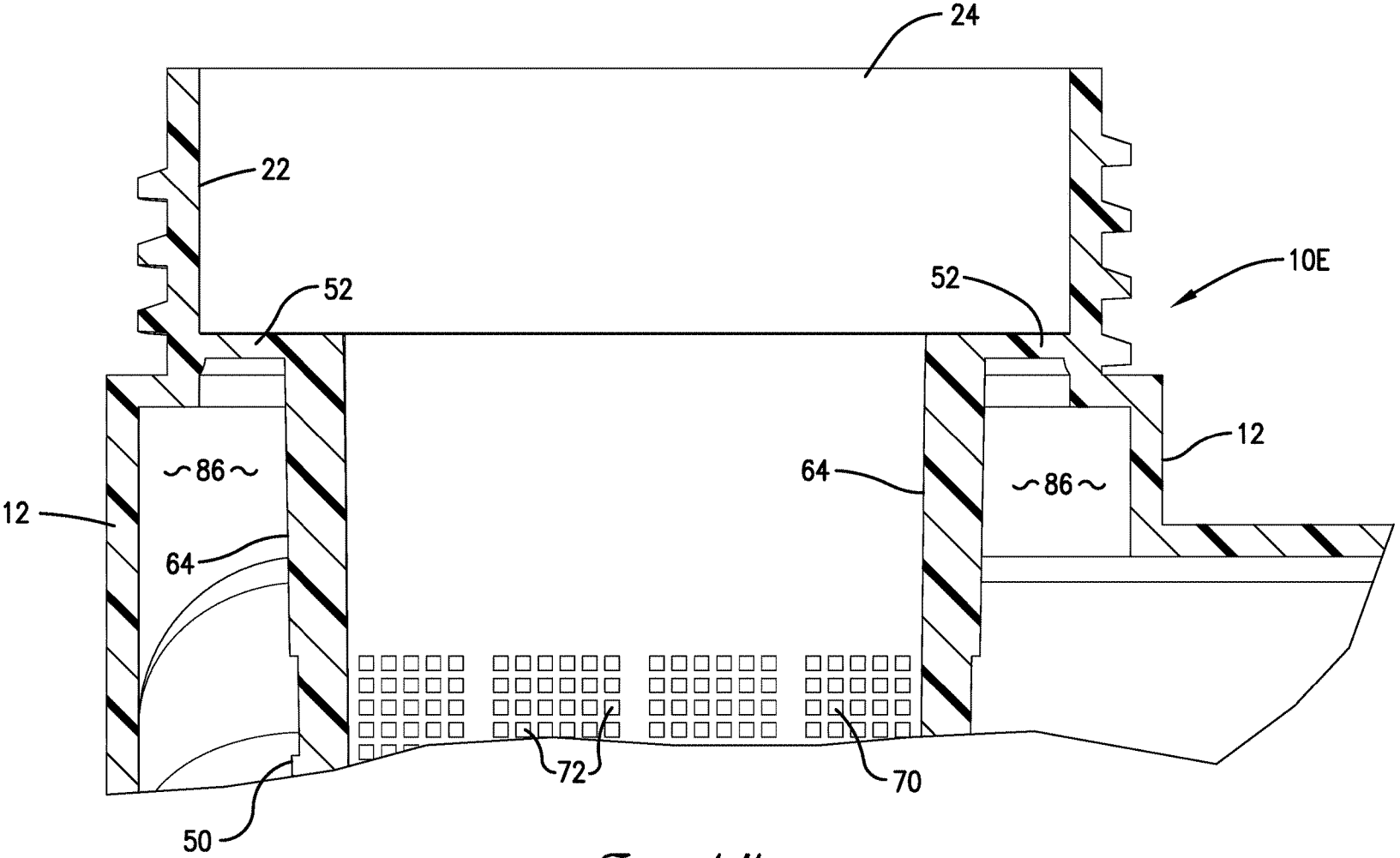
FIG. 14 is an enlarged left side elevation view showing the flash suppressor of FIG. 7 integrated into the neck of the container to provide a fuel-retaining pocket adjacent the neck and opening.
Figure 15:
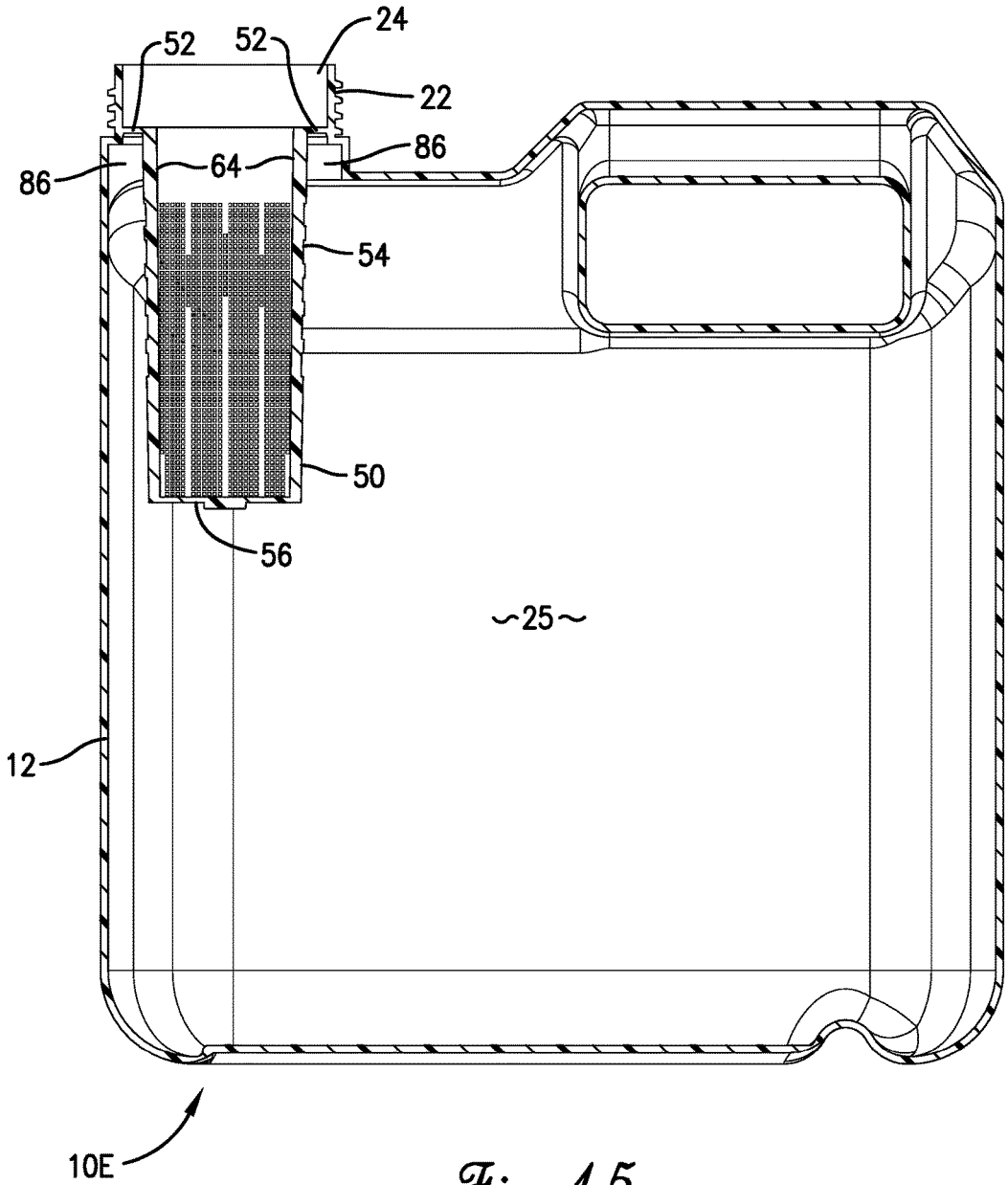
FIG. 15 is a vertical cross-sectional view taken through a fuel container and flash suppressor after integration of the flash suppressor into the fuel container.

In certain embodiments, it may be desired for the flash suppressor 50 be permanently attached (i.e., non-removable) to the body 12 by, for example, bonding or welding. One suitable welding technique is to spin-weld the flash suppressor 50 to the body 12 of the portable fuel container 10E. FIG. 12 shows the flash suppressor 50 inserted into the body 12 where the inner surface of the neck 22 is provided with a radially inwardly projecting circumferentially extending bulge 82, but before integration. In FIG. 13, the flash suppressor 50 is pushed downwardly so that the annular rim 52, which may have a beveled edge 84, is in interference with the bulge 82. The rim 52 thus engages the bulge 82, the sizing being complementary such that the rim 52 is sufficiently resilient and preferably able to deflect upon such engagement. The flash suppressor 50 is then rotated relative to the body sufficiently to melt and weld with the bulge 82 to make the flash suppressor unitary with the body 12, thereby creating a seal preventing air and liquid from moving between the annular rim 52 and the neck 22. This unitization of the flash suppressor 50 with the body 12 creates a reservoir 86 or pocket between the body 12, the rim 52 and the imperforate fuel-retaining wall 64 which retains a quantity of fuel therein when the portable fuel container is tipped or inverted.

Figure 16:
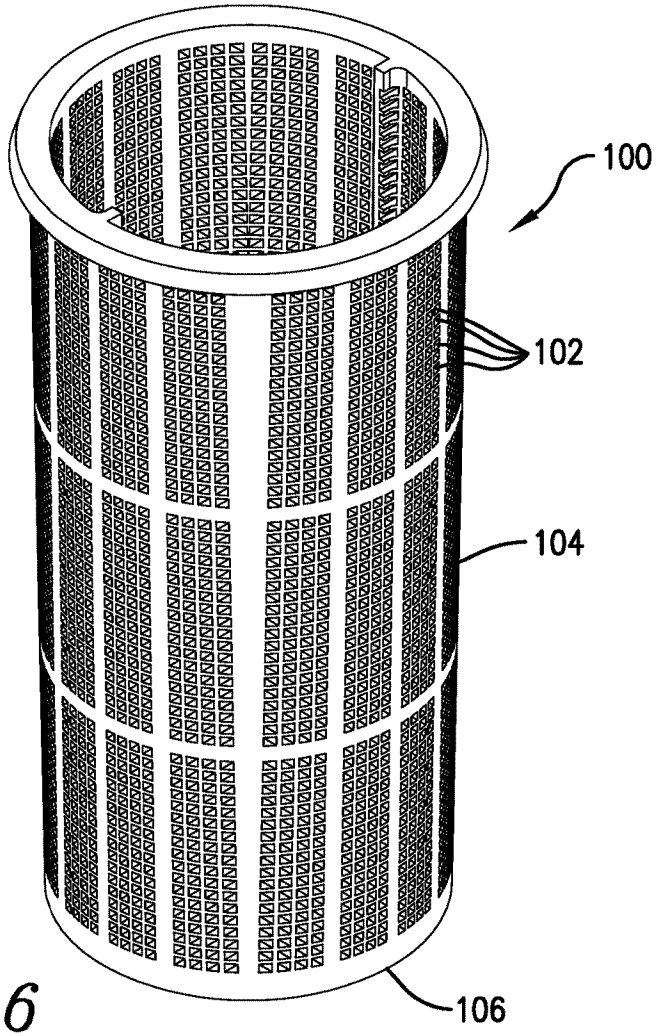
FIG. 16 is an isometric view of a flash suppressor for integrating inside the neck of a portable fuel container having a configuration similar to that of the flash suppressor depicted in FIG. 7, but configured without the fuel-retaining wall, so that fuel retention is accomplished primarily by retaining fuel in the perforations of the flash suppressor.

FIG. 16 depicts an alternative type of fuel retention structure, i.e., a flash suppressor 100, that employs a plurality of perforations 102 to retain a quantity of liquid fuel at or near the opening of the portable fuel container. After liquid fuel is dispensed from the portable fuel container though the perforations 102 and the container is returned to its upright position, the perforations 102 can retain a sufficient quantity of liquid fuel to make the environment inside the flash suppressor 100 too rich in fuel for combustion to occur. Unlike the flash suppressor 50 depicted in FIG. 7, which includes an imperforate fuel retention wall 64 extending around the top of the sidewall 54, the flash suppressor 100 depicted in FIG. 16 relies primarily, and in certain embodiments exclusively, on the perforations 102 for fuel retention. Although other types of fuel retention structures (e.g., absorptive pads, retention walls, etc.) can be incorporated into or used in conjunction with the flash suppressor 100, in certain embodiments, at least 50, 75, 90, 95, or about 100 weight percent of the liquid fuel retained by the flash suppressor 100 is retained within the perforations 102.

The dimensions of the flash suppressor 100 depicted in FIG. 16 are chosen to permit adequate fuel flow through the perforations during filling of the fuel container and adequate retention of fuel in the perforations 102 after dispensing fuel from the fuel container through the perforations 102. In certain embodiments, the perforations are configured in a manner such that after the liquid fuel has been dispensed from the container and the fuel retention structure is no longer submerged in the liquid fuel, a quantity of the liquid fuel is retained in the perforations due to intermolecular forces. The intermolecular forces include forces between molecules within the liquid fuel and forces between molecules of the liquid fuel and molecules of the fuel retention structure.

The perforations 102 of the flash suppressor 100 must provide sufficient open area, as defined previously, to permit fuel to flow adequately through flash suppressor 102 under standard fuel filling conditions without having fuel spill out over the top of the flash suppressor 100. In certain embodiments, the perforations 102 in the sidewall 104 and/or the bottom wall 106 of the flash suppressor 100 can cause the flash suppressor 100 to be at least 5, 10, 15, 20, or 25 percent open and/or not more than 90, 80, 70, 60, or 50 percent open, as defined previously. The total number or perforations in the flash suppressor can be at least 100, 500, 1000, or 2000 and/or not more than 40,000, 20,000, 10,000, or 5,000.

In certain embodiments, the flash suppressor 100 can have an internal volume of at least 5, 10, 14, or 16 cubic inches and/or not more than 40, 30, 25, or 20 cubic inches. Further, the flash suppressor 100 can have a length (typically measured as the height of the sidewall 104) that allows it to extend at least 2, 3, 4, or 5 inches and/or not more than 12, 10, 8, or 7 inches downwardly into the fuel container.

Figure 17:
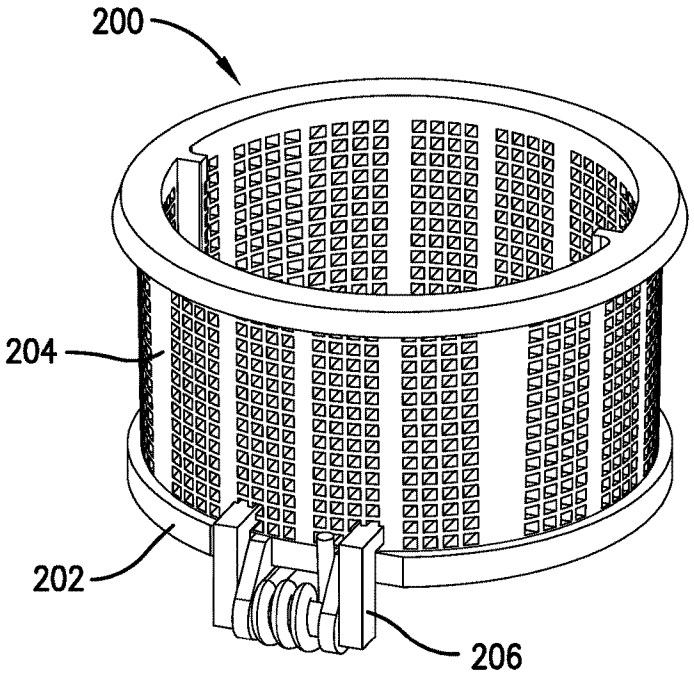
FIG. 17 is a top isometric view of a flash suppressor for integrating inside the neck of a portable fuel container having a bottom wall that is shiftable relative the sidewall, illustrating the bottom wall in a closed position.
Figure 19:
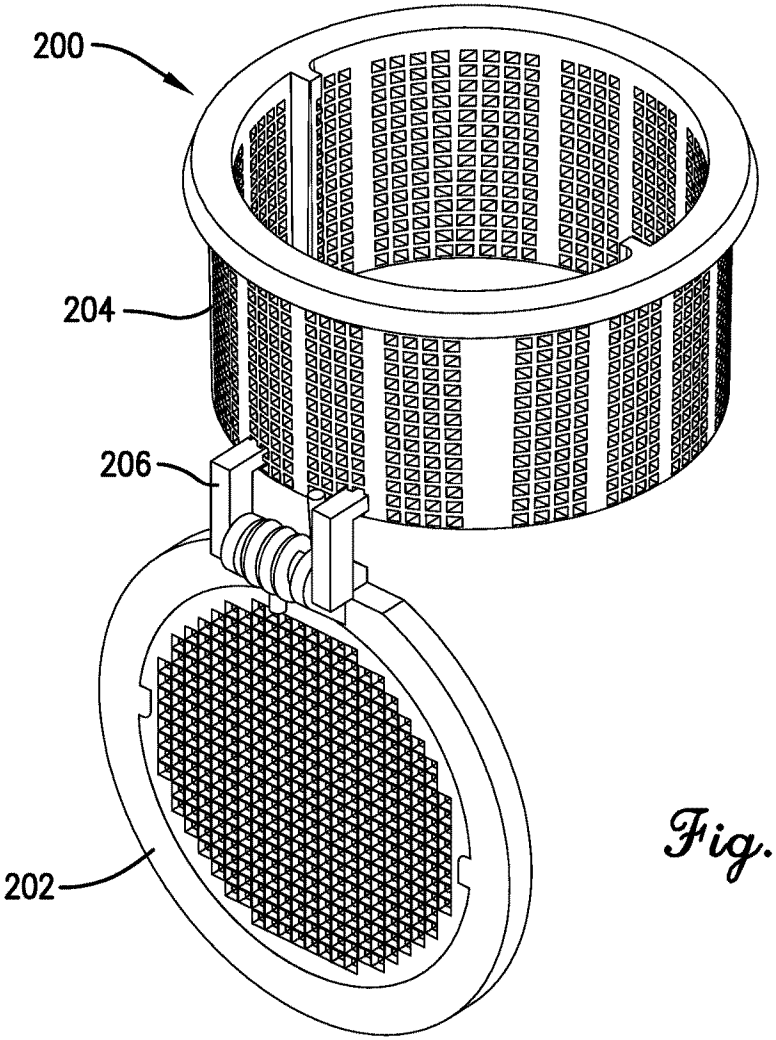
FIG. 19 is a top isometric view of the flash suppressor of FIG. 17, illustrating the bottom wall in an open position.
Figure 18:
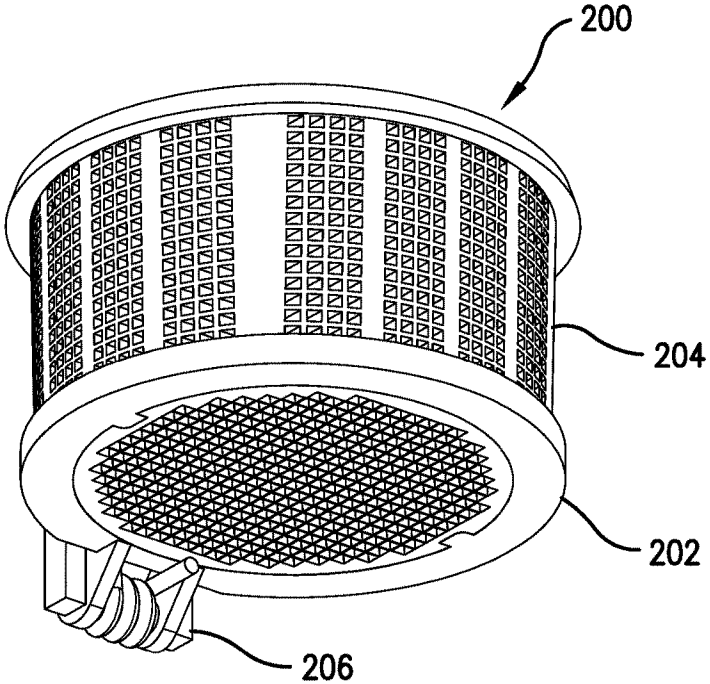
FIG. 18 is a bottom isometric view of the flash suppressor of FIG. 17, illustrating the bottom wall in a closed position.

The specific configuration (e.g., size, length, and shape) of the perforations 102 in the sidewall 104 and/or end wall 106 of the flash suppressor 100 can affect the ability of the perforations 102 to permit adequate fuel flow therethrough during filling and dispensing, while still permitting adequate fuel retention therein after dispensing. In certain embodiments, the perforations 102 can be sized to present an average perforation open area of at least 0.0005, 0.001, 0.0015, or 0.002 square inches and/or not more than 0.1, 0.05, 0.01, or 0.005 square inches. As used herein, "perforation open area" means the minimum cross-sectional area of a perforation, measured normal to the direct of extension of the perforation through the wall. As used herein, "average perforation open area" means the average of all open areas of all perforations in the flash suppressor. The perforations 102 can have an average perforation diameter of at least 0.01, 0.02, 0.03, 0.04, or 0.05 and/or not more than 0.4, 0.2, 0.1, or 0.08 inches. As used herein, "perforation diameter" means the maximum dimension across a perforation, measured normal to the direct of extension of the perforation through the wall. As used herein, "average perforation diameter" means the average of all perforation diameters of all perforations in the flash suppressor. The length of each perforation 102 can be determined by the thickness of the walls (i.e., sidewall 104 and/or end wall 106) of the flash suppressor 100. In certain embodiments, the average length of the perforations 102 and/or the average thickness of the sidewall 104 and/or the end wall 106 can be least 0.01, 0.02, 0.04, 0.06, or 0.08 inches and/or not more than 0.25, 0.2, 0.15 or 0.1 inches FIGS. 17-19 show a flash suppressor 200 that is similar to the flash suppressor 100 depicted in FIG. 16 in that is does not include an imperforate fuel retention dam near its opening; however, the flash suppressor 200 of FIGS. 17-19 includes a bottom wall 202 that is shiftable relative to the sidewall 204 between an closed position (shown in FIGS. 17 and 18) and an open position (shown in FIG. 19). In certain embodiments, the bottom wall 202 is biased toward the closed position and the bottom wall 202 is configured to be shifted into the open position by contact with a conventional gasoline pump nozzle (not shown) that is inserted though the main opening of the portable fuel container for filling of the container. The bottom wall 202 can automatically shift into the closed position when the fuel pump nozzle is removed from the flash suppressor 200 and the main opening of the portable fuel container. The shiftable bottom wall 202 provides the necessary open area for filling the container with liquid fuel through the flash suppressor 200. In contrast with the flash suppressor 100 illustrated in FIG. 16, liquid fuel does not have to pass through the perforations in the sidewall 204 or the bottom wall 202 of flash suppressor 200 in order to fill the container with fuel. Such a configuration allows the sidewall 204 of the flash suppressor 200 to be much shorter than the sidewall 104 of the flash suppressor 100 depicted in FIG. 16.

As depicted in FIGS. 17-19 the flash suppressor 200 can include a spring biased hinge 206 coupling the bottom wall 202 to the sidewall 204 and providing for the shiftability and biasing of the bottom wall 202 relative to the sidewall 204. Of course, biasing mechanisms other than the torsion spring depicted in FIGS. 17-19 can be employed to bias the bottom wall 202 toward the closed position Referring again to FIGS. 17 and 18, because the end wall 20 of the flash suppressor 200 is closed during dispensing of liquid fuel from the container, the liquid fuel must flow through the perforations in the end wall 202 and/or sidewall 204 in order to dispense liquid fuel from the container. After liquid fuel is dispensed from the container and the flash suppressor 200 is no longer immersed in fuel, flash suppressor 200 retains a quantity of fuel in its perforations that is sufficient to cause the environment in the flash suppressor 200 to be too rich in fuel to support combustion. In order to retain fuel, the perforations of flash suppressor 200 can have substantially the same configuration (e.g., average perforation open area, average perforation diameter, and average perforation length) as the perforations of the flash suppressor 100 depicted in FIG. 16. However, the total number of perforations, internal volume, and sidewall height are substantially less than those of the flash suppressor 100 depicted in FIG. 16.

In certain embodiments, the total number or perforations in the flash suppressor 200 can be at least 25, 50, 100, or 250 and/or not more than 10,000, 5,000, 2,500, or 1,000. In certain embodiments, the flash suppressor 200 can have an internal volume of at least 2, 4, or 6 cubic inches and/or not more than 200, 15, 12, or 10 cubic inches. Further, the flash suppressor 200 can have a length (typically measured as the height of the sidewall 204) that allows it to extend at least 0.25, 0.5, 0.75 or 1 inch and/or not more than 4, 3, 2, or 1.5 inches downwardly into the fuel container.

For each of the portable fuel containers 10A, 10B, 10C, 10D and 10E, it is contemplated that provided that 10 ml of gasoline per 1 U.S. gallon (3.785 liters) capacity of the fuel container is retained within the portable fuel container, the fuel-air mixture within the portable fuel container will be too rich to support combustion within the portable fuel container. Moreover, it is believed that approximately 6 ml of gasoline per 1 U.S. gallon (3.785 liters) capacity of the fuel container is retained within the portable fuel container will be too rich to support combustion within the portable fuel container. This is linearly scalable to various sizes of portable fuel containers as defined herein. Thus, for a five-gallon (18.927 liter) capacity portable fuel container, the neck dam alone, the absorbent pads alone, the pocket 36 alone, or the neck dam, pocket and absorbent pad(s) in any combination thereof will hold and retain at least 30 ml or at least 50 ml of gasoline within the portable fuel container 10. Thus, the size of the neck dam 26A or 26B, or the pocket 36, or the reservoir or pocket 86 formed by the body 12, rim 52 and imperforate fuel-retaining 64, or the absorbent pad(s) collectively should be sized corresponding to the volume capacity of the portable fuel container to retain the sufficient amount of fuel, in particular gasoline, described herein.

For the portable fuel containers 10A, 10B, 10C and 10E, a portion of the fuel 28 dispensed during pouring through the opening is retained immediately proximate the neck 22 and opening 24, thereby increasing the fuel-to-air ratio to a level whereby combustion may not occur. The positioning of the fuel retention structure in the neck proximate the opening 24 helps to inhibit the entry of flame into the chamber 25 of the container because the fuel is retained closely proximate the opening to maintain a too-rich mixture at the opening. For the portable fuel container 10D, the fuel is absorbed by the pads and retained in the chamber 25D within the main body 12D of the portable fuel container 10D to maintain the too rich fuel-air ratio for combustion. The portable fuel container 10E provides, in addition to the increased fuel-air ratio caused by the retention of fuel in the reservoir 86 or pocket, a barrier to the passage of spark or flame attempting to enter the chamber 25 by the suppressor sidewall 54 and bottom wall 56. The method hereof includes the steps of pouring fuel through the opening of a portable fuel container, and retaining a portion of the fuel in a retention member such as an absorbent pad or in a reservoir positioned proximate the opening so as to increase the ratio of fuel to air interiorly of the container, preferably proximate the opening.

Embodiments of the present invention may also include a flash suppressor in the form of flame mitigation device 300 as illustrated in FIGS. 20-24. In some embodiments, the flame mitigation device 300 may have similar features to those described above with respect to flash suppressor 100. However, it should be understood that flame mitigation device 300 may include any of the features previously-described with respect to flash suppressors 50, 100, and/or 200.

Figure 20:
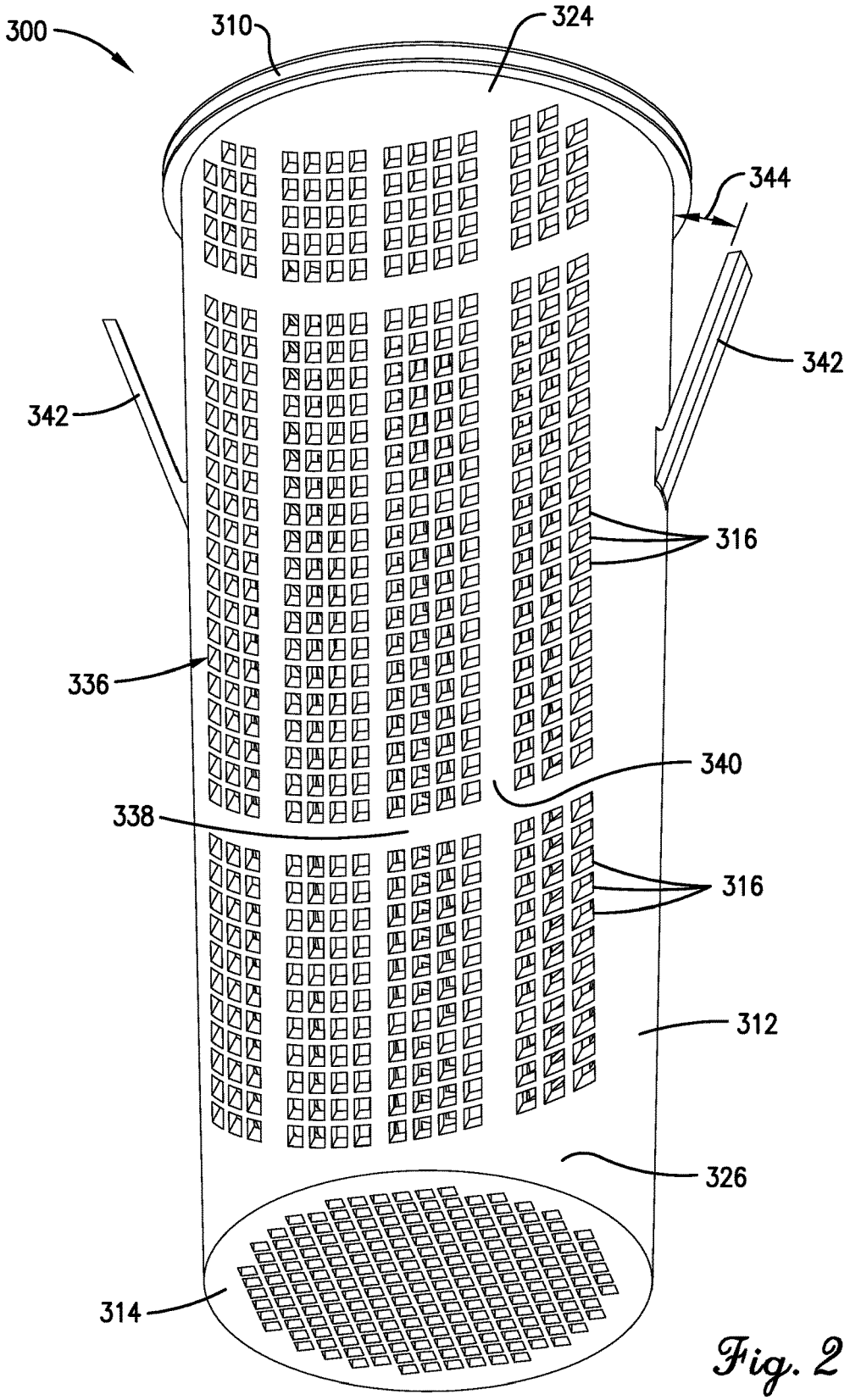
FIG. 20 is an bottom isometric view of a flame mitigation device according to embodiments of the present invention, with the flame mitigation device including downwardly-sloping perforations extending through a sidewall of the flame mitigation device.

As shown in FIG. 20, the flame mitigation device 300 may comprise an annular upper rim 310 and a cylindrical sidewall 312 extending down from the annular upper rim 310 to a bottom wall 314. The sidewall 312 may include a plurality of perforations 316 that extend through the sidewall 312. As perhaps best shown in FIG. 22, the perforations 316 may extend from an inner sidewall surface 318 of the sidewall 312 to an outer sidewall surface 320 of the sidewall 312. In some embodiments, one or more of the perforations 316 may be configured to slope downwardly (i.e., downwardly-sloping perforations) through the sidewall 312. Specifically, the perforations 316 may be configured to slope downwardly, with respect to a horizontal reference plane (illustrated by the dashed line in FIG. 22), as the perforations 316 extend from the inner sidewall surface 318 to the outer sidewall surface 320.

Figure 24:
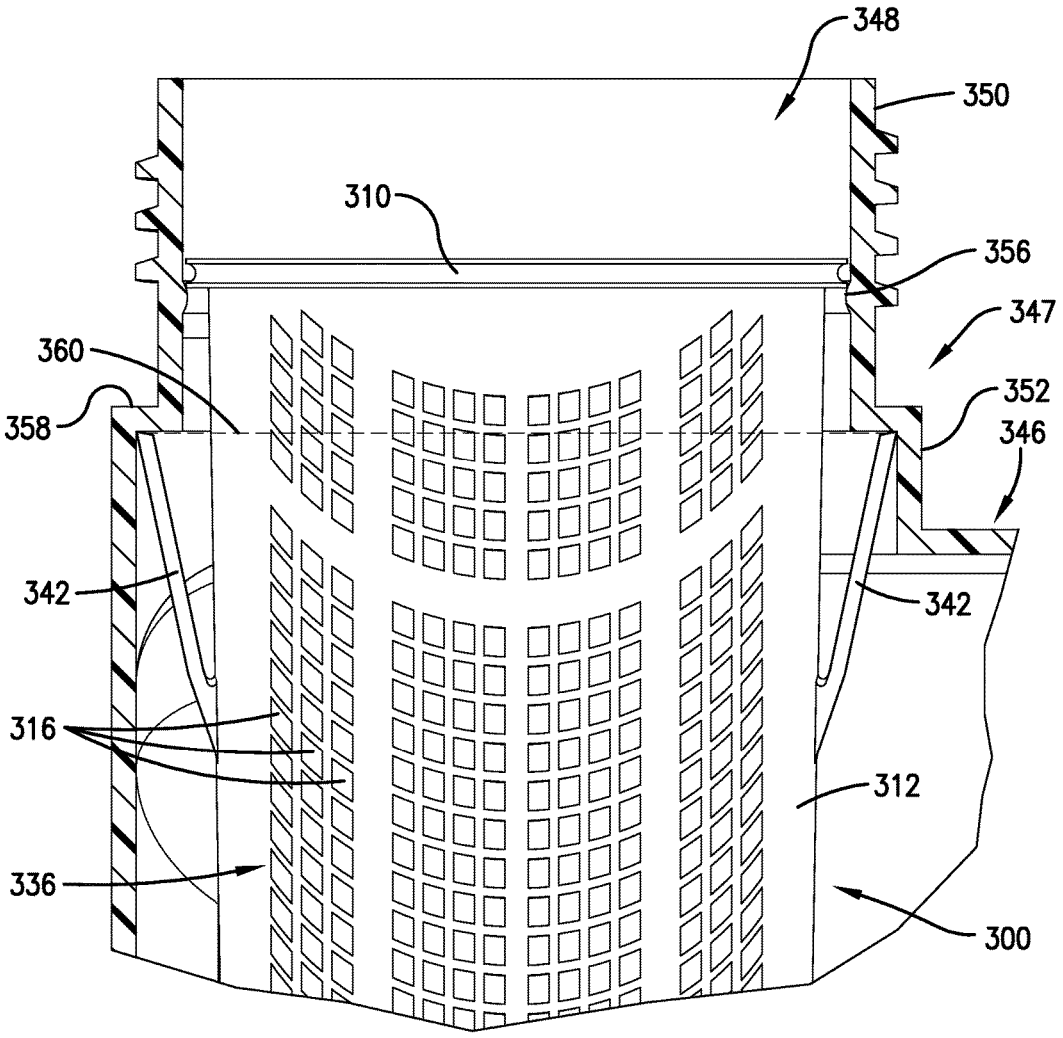
FIG. 24 is a cross-sectional broken away view of the neck of the fuel container from FIG. 23, with the flame mitigation device being secured within the main container opening of the fuel container by the wing elements expanding away from the sidewall of the flame mitigation device and into engagement with the main container opening.

The perforations 316 being configured to slope downwardly can aid in allowing liquid fuel to flow into and out of a fuel container when the flame mitigation device 300 is installed within a main container opening of the fuel container. Specifically, for instance, downwardly-sloping perforations 316 can provide for liquid fuel to pass through the flame mitigation device 300 at a high-enough rate to prevent spillage while the fuel container is being filled at standard gas pump flow rates. In more detail, FIG. 24 illustrates flame mitigation device 300 being installed within a main container opening of a fuel container. As shown, the orientation of the flame mitigation device 300 provides for the openings of the perforations 316 on the inner sidewall surface 318 to be positioned higher on the sidewall 312 than corresponding openings of the perforations 316 on the outer sidewall surface 320. As such, liquid fuel can more easily flow through the flame mitigation device 300 and into the fuel-receiving chamber of the fuel container as the fuel container is being filled (e.g., via a fuel nozzle). Similarly, when the fuel container is tipped to dispense liquid fuel, the angle of the perforations 316 provide for liquid fuel to more easily flow from the fuel-receiving chamber of the fuel container, through the perforations 316, past the flame mitigation device 300, and out of the fuel container. The downwardly sloping perforations 316 can be particularly important for flame mitigation devices 300 having smaller diameters, such as flame mitigation devices having inner diameters, e.g., at an upper end 324 (See FIG. 20) near the annular rim 310, of less than 2.5 inches, less than 2.25 inches, less than 2 inches, less than 1.75 inches, or less than 1.5 inches.

Figure 22:
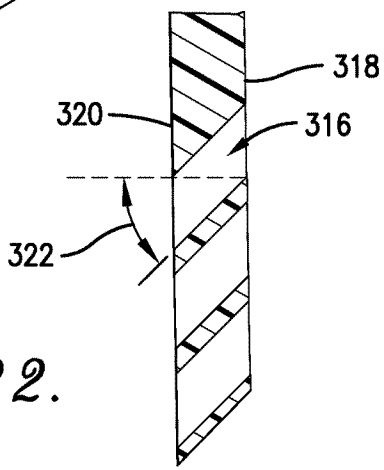
FIG. 22 is a cross-sectional view taken along the line 22-22 from FIG. 21, and particularly illustrating the downwardly-sloping perforations.

In some embodiments, the perforations 316 may extend downward at an angle 322 from the inner sidewall surface 318 to the outer sidewall surface 320, as best shown in FIG. 22. The angle 322 of the downwardly sloping perforations 316 may generally be measured relative to a horizontal plane (illustrated by the horizontal dashed line in FIG. 22), which is horizontal when the flame mitigation device 300 is oriented with its upper end 324 directly over its lower end 326 (i.e., when a central, longitudinal axis of the flame mitigation device 30 is vertical). As such, the horizontal plane may be considered parallel to the annular rim 310 and perpendicular to the central, longitudinal axis of the flame mitigation device 30. In certain embodiments, the angle 322 of the downwardly sloping perforations 316 may be at least 1 degree, at least 2.5 degrees, at least 5 degrees, at least 10 degrees, at least 20 degrees, at least 30 degrees, at least 40 degrees, a least 50 degrees, at least 60 degrees, or at least 70 degrees. In certain embodiments the angle 322 of the downwardly sloping perforations 316 may not be more than 85 degrees, not more than 75 degrees, not more than 65 degrees, not more than 55 degrees, not more than 45 degrees, not more than 35 degrees, not more than 25 degrees, not more than 15 degrees, or not more than 5 degrees.

Figure 21:
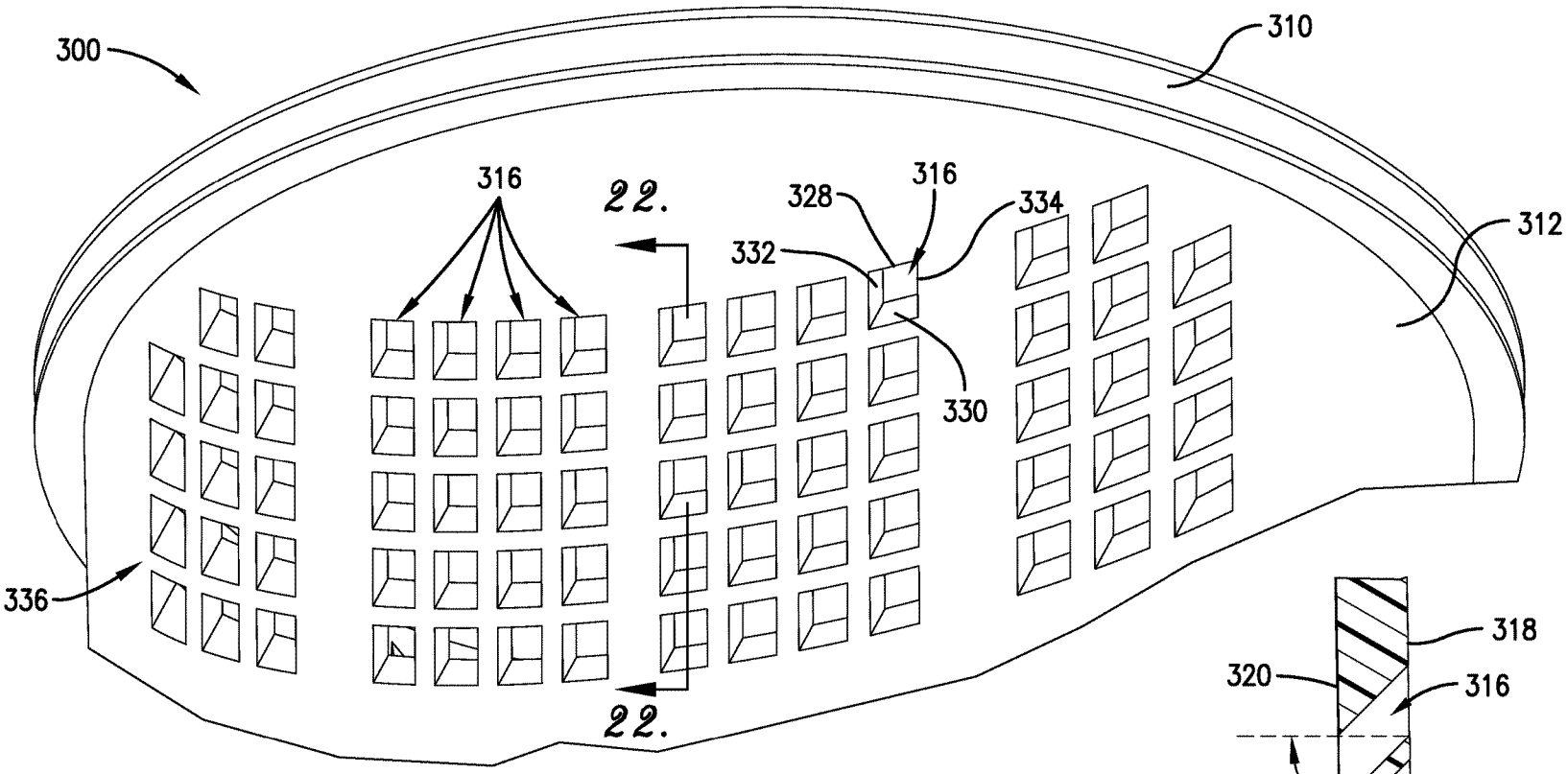
FIG. 21 is an enlarged view of a broken-away top portion of the flame mitigation device from FIG. 20, particularly illustrating the downwardly-sloping perforations extending through the sidewall.

With reference to FIG. 21, in various embodiments, the perforations 316 may be formed with an upper perforation surface 328, a lower perforation surface 330, and a pair of side perforation surfaces 332, 334. The angle 322 of the perforation 316 may be characterized by the angle formed by either of the upper and/or lower perforation surfaces 328, 330 with respect to horizontal. For example, FIG. 22 shows the lower perforation surface 330 sloping downwardly from the inner sidewall surface 318 to the outer sidewall surface 320 at the angle 322, which is illustrated to be about 45 degrees. In FIG. 22, the upper perforation surface 332 is also sloping downwardly from the inner sidewall surface 318 toward the outer sidewall surface 320 at the angle 322. However, it should be understood that, in some embodiments, only one of the upper and/or lower perforation surfaces 328, 330 may slope downward at the angle 322. Although the perforation surfaces 328, 330, 332, and 334 are illustrated in the drawings as generally flat surfaces, which together form a parallelogram-type shape, it is foreseen that the perforations surfaces 328, 330, 332, and 334 may be curved and may form any suitable shape.

In some embodiments, each of the perforations 316 included on the flame mitigation device 300 may be downward sloping. In other embodiments, the flame mitigation device 300 may include some perforations that extend generally horizontally, and are, thus, not downward sloping. For example, in certain embodiments, at least 20 percent, at least 30 percent, at least 40 percent, at least 50 percent, at least 60 percent, at least 70 percent, at least 80 percent, at least 90 percent, or 100 percent of the perforations 316 of the flame mitigation device 300 may downwardly sloping. Similarly, in certain embodiments, at least 20 percent, at least 30 percent, at least 40 percent, at least 50 percent, at least 60 percent, at least 70 percent, at least 80 percent, at least 90 percent, or 100 percent of the total open area defined by perforations 316 that are downwardly sloping.

In some embodiments, as shown in FIG. 20, the perforations 316 may be arranged about the flame mitigation device 300 in sections 336, with each section 336 including an array of perforations 316. In some embodiments, each perforation 316 in a section 336 may extend downward along the same angle 322, while in other embodiments, the downward angle 322 for one or more of perforation 316 in a given section 336 may vary. Because, in some embodiments, the sidewall 312 of the flame mitigation device 300 may be generally cylindrical, the sections 336 may extend arcuately about the sidewall 312. As such, as illustrated in FIG. 20, adjacent sections 336 may be spaced from one another axially by an axial imperforate section 338. Similarly, adjacent sections 336 may be spaced from one another circumferentially by a circumferential imperforate section 340.

Figure 23:
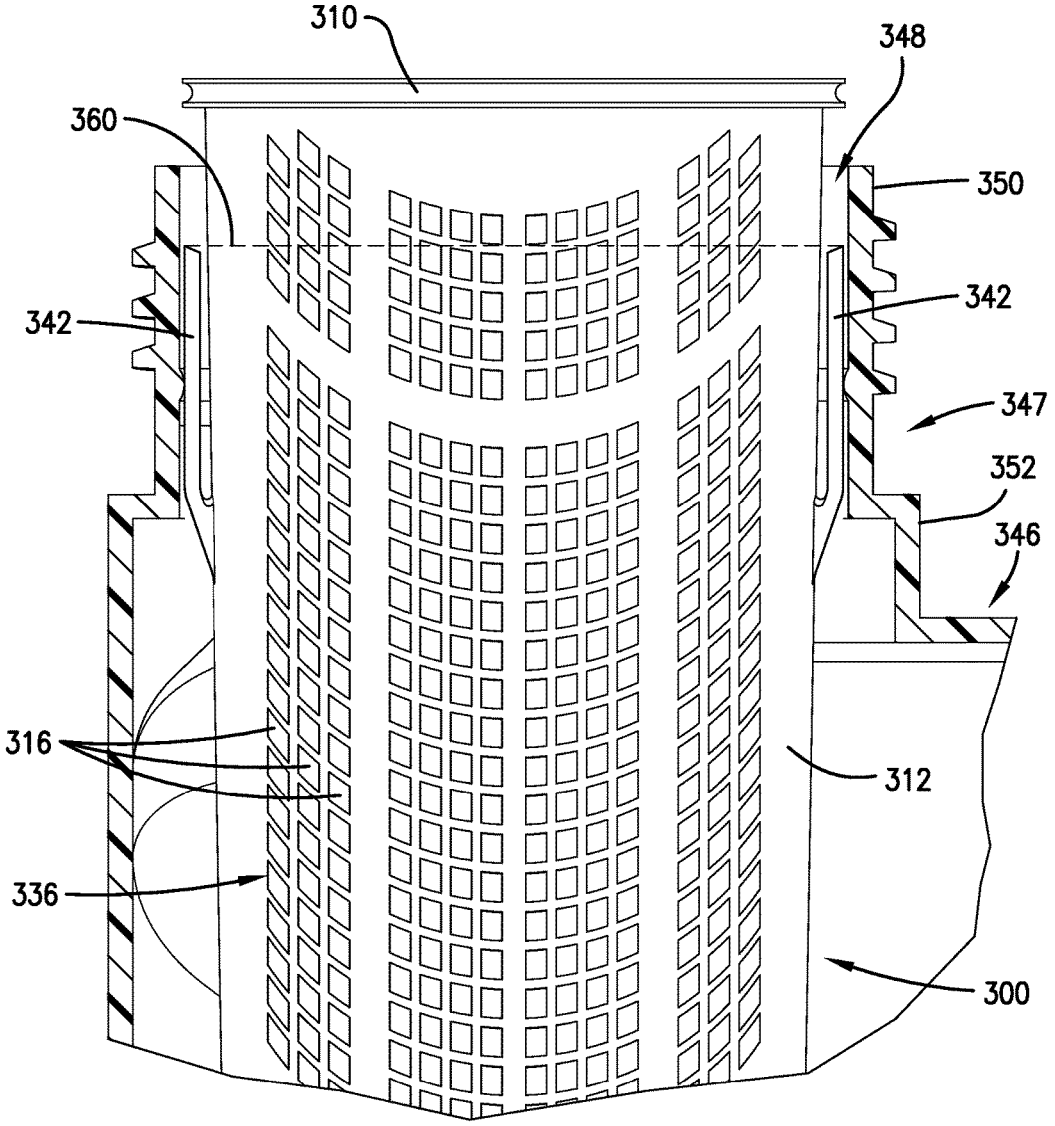
FIG. 23 is a cross-sectional broken away view of a neck of a fuel container with the flame mitigation device from FIG. 21 being inserted within a main container opening of the fuel container, particularly illustrating the flame mitigation device including wing elements compressed against the sidewall of the flame mitigation device.

In some embodiments, as shown in FIGS. 20, 23, and 24, the flame mitigation device 300 may further comprising one or more wing elements 342 used to facilitate a secure connection between the flame mitigation device 300 and a fuel container. In more detail, the wing elements 342 may comprise elongated prongs or barbs that are flexibly connected at a proximate end to the sidewall 312. The wing elements 342 may be configured to extend outward from the sidewall 312 (or an outer sidewall surface 320 of the sidewall 312), as shown in FIG. 20, such that a distal end, or free end, of the wing elements 342 may normally be spaced apart from the sidewall 312.

In general, the wing elements 342 may extend in an upward direction, at an angle 344 with respect to the sidewall 312. The angle 344 at which the wing elements 342 extend relative to the sidewall 312 may be of at least 1 degrees, at least 2.5 degrees, at least 5 degrees, at least 10 degrees, at least 20 degrees, at least 30 degrees, at least 40 degrees, a least 50 degrees, at least 60 degrees, or at least 70 degrees, and/or not more than 85 degrees, not more than 75 degrees, not more than 65 degrees, not more than 55 degrees, not more than 45 degrees, not more than 35 degrees, not more than 25 degrees, not more than 15 degrees, or not more than 5 degrees. In FIG. 20, the wing elements 342 are shown extending upward at an angle 344 of about 30 degrees relative to the sidewall 312.

Although the figures illustrate that the flame mitigation device 300 includes two wing elements 342, which are positioned on opposite sides of the flame mitigation device 300, it is contemplated that the flame mitigation device 300 may comprise any number of wing elements 342 as may be necessary to secure the flame mitigation device 300 to a fuel container. In some embodiments, the wing elements 342 may be formed of the same material from which the flame mitigation device 300 is formed, such that the wing elements 342 may be integrally formed with the sidewall 312. For example, the wing elements 342 may be formed from a synthetic resin material, such as polyethylene or polypropylene.

In operation, as illustrated in FIGS. 23 and 24, a user may secure the flame mitigation device 300 to a fuel container 346. Specifically, the flame mitigation device 300 may be secured to a neck 347 of the fuel container 346, with the neck presenting a main container opening 348 through which liquid fuel can be added to or extracted from the fuel container 346. In some embodiments, as shown in FIGS. 23 and 24, the neck 347 may comprise an upper portion 350 having a first inner diameter, and a lower portion 352 having a second inner diameter. The lower portion 352 may, in some embodiments be larger than the upper portion 350, such that the second diameter is greater than the first diameter.

To secure the flame mitigation device 300 to the fuel container 346, the flame mitigation device 300 can be inserted through the main container opening 348, as presented by the neck 347 of the fuel container 346. As described in more detail below, the wing elements 342 are configured to assist in securing the flame mitigation device 300 within the main container opening 348. To properly insert the flame mitigation device 300 into the main container opening 348, the flame mitigation device 300 should be inserted with its lower end 326 first, such that the wing elements 342 extend in an upward direction. As the flame mitigation device 300 is inserted within the main container opening 348, the wing elements 342 come into contact with an interior surface of the upper portion 350 of the neck 347, which causes the wing elements 342 to compress towards the sidewall 312, as is shown in FIG. 23. In some embodiments, the wing elements 342 will be compressed to a position adjacent to the sidewall 312 as the wing elements 342 pass along the upper portion 350 of the neck 347.

As shown in FIG. 34, once the flame mitigation device 300 has been sufficiently inserted within the main container opening 348, such that the wing elements 342 have passed beyond the upper portion 350 of the neck 347, the wing elements 342 are free to expand away from the sidewall 312 of the flame mitigation device 300 until the wing elements 342 come into contact with the lower portion 352 of the neck 347. Such expansion is generally made possible due to the larger inner diameter of the lower portion 352 of the neck, as compared with the inner diameter of the upper portion 350 of the neck 347. The wing elements 342 will generally expand outward until they come into contact with the lower portion 352 of the neck 347. In such a position, the flame mitigation device 300 will be secured within the main container opening 348 and inhibited from being removed from the fuel container 346. Specifically, as shown in FIG. 24, the flame mitigation device 300 will be restricted from moving upwards by way of an interference between the free, distal ends of the wing elements 342 and a connection element 358 of the neck 347, with the connection element 358 connecting the upper portion 350 of the neck 347 to the lower portion 352 of the neck. The flame mitigation device 300 may also be restricted from moving downwards by an annular bulge 356 that extends around (i.e., circumscribes) the interior surface of the upper portion 350 of the neck 347. Specifically, such a bulge 356 may interfere with the annular rim 310 of the flame mitigation device 300 so as to prevent the flame mitigation device 300 from falling down within the fuel container 346.

Embodiments of the flame mitigation device 300 may provide for a wing distance 360, as shown in FIGS. 23 and 34, to be defined as a distance between free, distal ends of opposing wing elements 342. As shown in FIG. 23, when the wing elements 342 are passing along the upper portion 350 of the neck 347, then the wing elements 342 will be in a compressed state, such that the wing distance 360 is less than the inner diameter of upper portion 350 of the neck 347. In contrast, as shown in FIG. 24, after the wing elements 342 have passed beyond the upper portion 350 of the neck 347, the wing elements 342 will expand such that the wing distance 360 is greater than the inner diameter of upper portion 350 of the neck 347. As such, the wing distance 360 of the flame mitigation device 300 in the expanded state is greater than the wing distance 360 of the flame mitigation device 300 in the compressed state.

It should be understood that the dimensions, values, and/or angles provided above, with reference to the figures may be varied. For example, in certain embodiments, each dimension/angle can be varied by +/−10%, +/−25%, or +/−50%. For example, a dimension of 10 inches in FIG. 20 or 24 provides support for the following claim ranges: 9 to 11 inches (i.e., 10 inches +/−10%), 7.5 to 12.5 inches (i.e., 10 inches +/−25%), and 5 to 15 inches (i.e., 10 inches +/−50%). Further, the upper and lower bounds of the ranges can be use by themselves or together. For example, a range of 7.5 to 12.5 inches provides support for a claimed length of at least 7.5 inches (with no upper end) and a claimed length of not more than 12.5 inches (with no lower end).

Although the invention has been described with reference to the one or more embodiments illustrated in the figures, it is understood that equivalents may be employed and substitutions made herein without departing from the scope of the invention as recited in the claims.

Having thus described one or more embodiments of the invention, what is claimed as new and desired to be protected by Letters Patent includes the following:

1. A method for coupling a flame mitigation device to a fuel container, wherein the fuel container comprises a hollow tank body defining a fuel-receiving chamber and a main container opening for permitting flow of a liquid fuel into and out of the fuel-receiving chamber, wherein said method comprises the steps of:

providing the flame mitigation device comprising a sidewall defining a plurality of perforations through which liquid fuel flows when dispensing liquid fuel from the fuel-receiving chamber, and wherein the flame mitigation device further comprises a pair of wing elements extending outwardly from the sidewall, wherein at least a portion of the wing elements are spaced apart from an imperforate section of the sidewall; and inserting the flame mitigation device through the main container opening of the fuel container, wherein during said inserting step, the wing elements are compressed adjacent to an outer surface of the sidewall; and securing the flame mitigation device within the main container opening of the fuel container, wherein during said securing step, the wing elements expand away from the outer surface of the sidewall.

2. The method of claim 1, wherein at least a portion of the perforations defined in the sidewall are downwardly sloping perforations having a downward angle of at least 1 degree below horizontal, and wherein at least 20 percent of the total open area defined by all of the perforations is attributable to downwardly sloping perforations.

3. The method of claim 1, wherein the wing elements are configured to inhibit the flame mitigation device from being removed from the main container opening.

4. The method of claim 1, wherein the fuel container includes a neck that defines the main container opening, wherein during said inserting step, a distance between a distal end of one wing element and a distal end of an opposing wing element is less than an inner diameter of a portion the neck, wherein during said securing step, the distance between the distal end of the one wing element and the distal end of the opposing wing element is greater than the inner diameter of the portion the neck.

5. The method of claim 1, wherein the flame mitigation device has an upper end having an inner diameter of less than 2.5 inches.

6. The method of claim 1, wherein the perforations are configured in a manner such that after the liquid fuel has been dispensed from the fuel container and the flame mitigation device is not submerged in liquid fuel contained within the fuel-receiving chamber, a quantity of the liquid fuel is retained in the perforations.

7. The method of claim 6, wherein the retained quantity of the liquid fuel is held in the perforations by intermolecular forces, wherein the intermolecular forces are sufficient to retain the quantity of liquid fuel in the perforations regardless of the orientation of the flame mitigation device.

* * * * *